US009918535B2

(12) United States Patent
Jose

(10) Patent No.: US 9,918,535 B2
(45) Date of Patent: Mar. 20, 2018

(54) LUGGAGE EXTENSION HANDLE HAVING A POCKET

(71) Applicant: Boban Jose, San Ramon, CA (US)

(72) Inventor: Boban Jose, San Ramon, CA (US)

( * ) Notice: Subject to any disclaimer, the term of this patent is extended or adjusted under 35 U.S.C. 154(b) by 169 days.

(21) Appl. No.: 14/710,566

(22) Filed: May 12, 2015

(65) Prior Publication Data

US 2016/0235176 A1 Aug. 18, 2016

Related U.S. Application Data

(63) Continuation-in-part of application No. 14/622,849, filed on Feb. 14, 2015, now Pat. No. 9,723,902.

(60) Provisional application No. 62/150,262, filed on Apr. 20, 2015.

(51) Int. Cl.

| | |
|---|---|
| ***A45C 13/26*** | (2006.01) |
| ***A45C 13/28*** | (2006.01) |
| ***A45F 4/02*** | (2006.01) |

(52) U.S. Cl.

CPC ..... *A45C 13/262* (2013.01); *A45C 13/28* (2013.01); *A45F 4/02* (2013.01); *A45C 2013/267* (2013.01); *A45C 2200/15* (2013.01); *A45F 2200/0525* (2013.01)

(58) Field of Classification Search

CPC ..... A45C 2013/265; A45C 13/262
USPC ..... 190/39, 115
See application file for complete search history.

(56) References Cited

U.S. PATENT DOCUMENTS

| | | | | |
|---|---|---|---|---|
| 853,566 | A | 5/1907 | Sparks | |
| 2,416,783 | A | 11/1944 | Vallieres | |
| 2,538,616 | A | 1/1945 | Cross | |
| 2,517,178 | A | 8/1950 | Cheatham | |
| 2,718,943 | A | 11/1954 | Braverman | |
| 3,606,372 | A | 9/1971 | Browning | |
| 3,814,220 | A | 6/1974 | Brody | |
| 4,146,045 | A | 3/1979 | Grant | |
| 4,160,496 | A | 7/1979 | Knight | |
| 4,221,402 | A * | 9/1980 | Kazmark | B62B 1/125 280/47.18 |
| 4,538,709 | A | 9/1985 | Williams et al. | |
| 4,588,056 | A | 5/1986 | Bernbaum | |
| 4,795,186 | A | 1/1989 | Tyus | |
| 5,265,307 | A | 11/1993 | Hull et al. | |
| 5,375,685 | A | 12/1994 | Plath | |

(Continued)

FOREIGN PATENT DOCUMENTS

| | | | |
|---|---|---|---|
| DE | 202009010549 | U1 | 10/2009 |
| WO | 0152687 | A | 7/2001 |

(Continued)

OTHER PUBLICATIONS

Search Report and Written Opinion dated May 13, 2016 from International Serial No. PCT/US2016/017464 filed Feb. 11, 2016.

(Continued)

*Primary Examiner* — Sue A Weaver

(57) ABSTRACT

A handle includes a first handle rod having a distal end and a proximal end, a second handle rod having a distal end and a proximal end, the second handle rod coupled to the first handle rod and disposed parallel to the first handle rod, a grip coupled to the distal end of the first handle rod and to the distal end of the second handle rod, and a pocket disposed between the first handle rod and the second handle rod.

21 Claims, 32 Drawing Sheets

(56) References Cited

U.S. PATENT DOCUMENTS 5,407,405 A * 4/1995 Oren ..... A63B 7/02 482/106
5,433,303 A 7/1995 Chen
5,464,080 A 11/1995 Liang
5,564,538 A 10/1996 Sadow
5,699,886 A 12/1997 Latshaw
5,806,143 A 9/1998 Tsai
5,904,230 A 5/1999 Peterson
5,924,533 A 7/1999 Cnockaert et al.
6,024,264 A 2/2000 Java
6,105,508 A 8/2000 Ryburg
6,213,265 B1 4/2001 Wang
6,279,706 B1 8/2001 Mao
6,357,080 B1 3/2002 Tsai
6,470,533 B1 * 10/2002 Comstock ..... A45F 5/102 16/406
6,540,134 B1 4/2003 Rasche
6,543,796 B1 4/2003 Johnson et al.
6,564,426 B1 5/2003 Wang
6,776,300 B2 8/2004 Walsh et al.
6,898,823 B2 5/2005 Tsai
6,978,514 B2 12/2005 Kuo et al.
7,328,796 B2 2/2008 Brunson et al.
7,445,216 B1 11/2008 Chou
7,451,861 B2 11/2008 Bhavnani
7,617,956 B1 11/2009 Sabbah
7,832,532 B2 11/2010 Nykoluk et al.
7,845,508 B2 12/2010 Rothschild et al.
7,987,955 B2 8/2011 Puchalski
8,317,558 B2 11/2012 Bucknell et al.
8,613,349 B1 12/2013 Halko et al.
8,662,267 B1 3/2014 Hart et al.
8,869,960 B2 10/2014 Mangano
9,277,796 B1 3/2016 Elam
2002/0056736 A1 5/2002 Conte
2002/0084159 A1 7/2002 Hamlin
2002/0096410 A1 7/2002 Nykoluk
2003/0102195 A1 * 6/2003 Mittleman ..... A45C 13/262 190/115
2003/0132079 A1 * 7/2003 Bellini ..... A45C 13/262 190/115
2004/0108345 A1 6/2004 Oh
2004/0181906 A1 9/2004 Kuo et al.
2004/0238304 A1 12/2004 Fisher
2005/0011043 A1 1/2005 Comstock
2005/0015932 A1 1/2005 Tsai
2005/0016809 A1 1/2005 Wu
2005/0082131 A1 4/2005 Fenton et al.
2005/0098402 A1 5/2005 Cohen
2005/0183914 A1 8/2005 Lin
2006/0037825 A1 2/2006 Dayton et al.
2006/0076203 A1 4/2006 Miller
2006/0118376 A1 6/2006 Godshaw et al.
2006/0272126 A1 12/2006 Burgess et al.
2007/0007801 A1 1/2007 Bishop
2007/0012593 A1 1/2007 Kitchens et al.
2007/0089952 A1 4/2007 Herbst et al.
2007/0164064 A1 7/2007 Nathan
2008/0078790 A1 4/2008 Bolling
2010/0051633 A1 * 3/2010 Porte ..... A45C 5/14 220/737
2010/0089778 A1 4/2010 Park
2010/0282556 A1 11/2010 Tseng et al.
2010/0313383 A1 12/2010 Lai
2011/0132708 A1 * 6/2011 DeLine ..... A45C 13/00 190/18 A
2011/0209960 A1 9/2011 MacLean et al.
2012/0217109 A1 8/2012 King et al.
2012/0273314 A1 11/2012 Raymond et al.
2012/0325607 A1 12/2012 Webster et al.
2013/0032443 A1 2/2013 Soedomo
2013/0075213 A1 3/2013 Chi Yueh Chen et al.
2013/0075214 A1 3/2013 Chen et al.
2013/0098410 A1 4/2013 Prasannakumar et al.
2013/0153351 A1 6/2013 House
2013/0175130 A1 7/2013 Liang
2013/0233362 A1 9/2013 Miller-Klerer
2013/0264160 A1 10/2013 Mediamolle
2014/0151172 A1 6/2014 Diaz
2014/0238799 A1 8/2014 Sharma
2014/0299428 A1 10/2014 Gadbois
2015/0047939 A1 2/2015 Chang
2015/0272291 A1 10/2015 Sener et al.
2015/0348347 A1 12/2015 Diz et al.
2016/0113388 A1 4/2016 Distefano

FOREIGN PATENT DOCUMENTS

WO 2009027992 A2 3/2009
WO 2009039154 A1 3/2009
WO WO 2013080236 A1 * 6/2013 ..... A45C 13/262

OTHER PUBLICATIONS

Search Report and Written Opinion dated May 13, 2016 from International Serial No. PCT/US2016/017470 filed Feb. 11, 2016.
Search Report and Written Opinion dated May 13, 2016 from International Serial No. PCT/US2016/017475 filed Feb. 11, 2016.
Search Report and Written Opinion dated May 19, 2016 from International Serial No. PCT/US2016/017447 filed Feb. 11, 2016.
Search Report and Written Opinion dated Aug. 31, 2016 from International Serial No. PCT/US2016/036485 filed Jun. 8, 2016.
Search Report and Written Opinion dated Aug. 31, 2016 from International Serial No. PCT/US2016/036494 dated Jun. 8, 2016.

* cited by examiner

LUGGAGE EXTENSION HANDLE HAVING A POCKET

TECHNICAL FIELD

The device and methods disclosed herein relate generally to luggage, and particularly to extensible handles for luggage.

BACKGROUND ART

Many people choose to use suitcases with extension handles when traveling. The extension handles make it possible to tow luggage behind the user rather than carrying the luggage in hand or using shoulder straps. The result is less strain and exertion for the user, particularly where the luggage in question has wheels. Currently existent extension handles, however, can be somewhat unwieldy to grip, and provide mobility that is less than ideal. Current designs also fail to take advantage of the opportunities afforded by the additional structure that extension handles represent for use with accessories.

Therefore, there remains a need for a luggage with more ergonomic extension handles having more features for user convenience.

SUMMARY OF THE EMBODIMENTS

In one aspect, a handle includes a first handle rod having a distal end and a proximal end. The handle includes a second handle rod having a distal end and a proximal end, the second handle rod coupled to the first handle rod and disposed parallel to the first handle rod. The handle includes a grip coupled to the distal end of the first handle rod and to the distal end of the second handle rod. The handle includes a pocket disposed between the first handle rod and the second handle rod.

Other aspects, embodiments and features of the disclosed device and method will become apparent from the following detailed description of the invention when considered in conjunction with the accompanying figures. The accompanying figures are for schematic purposes and are not intended to be drawn to scale. In the figures, each identical or substantially similar component that is illustrated in various figures is represented by a single numeral or notation at its initial drawing depiction. For purposes of clarity, not every component is labeled in every figure. Nor is every component of each embodiment of the device and method is shown where illustration is not necessary to allow those of ordinary skill in the art to understand the device and method.

BRIEF DESCRIPTION OF THE DRAWINGS

The preceding summary, as well as the following detailed description of the disclosed device and method, will be better understood when read in conjunction with the attached drawings. It should be understood that the invention is not limited to the precise arrangements and instrumentalities shown.

DETAILED DESCRIPTION OF SPECIFIC EMBODIMENTS

Figure 1A:
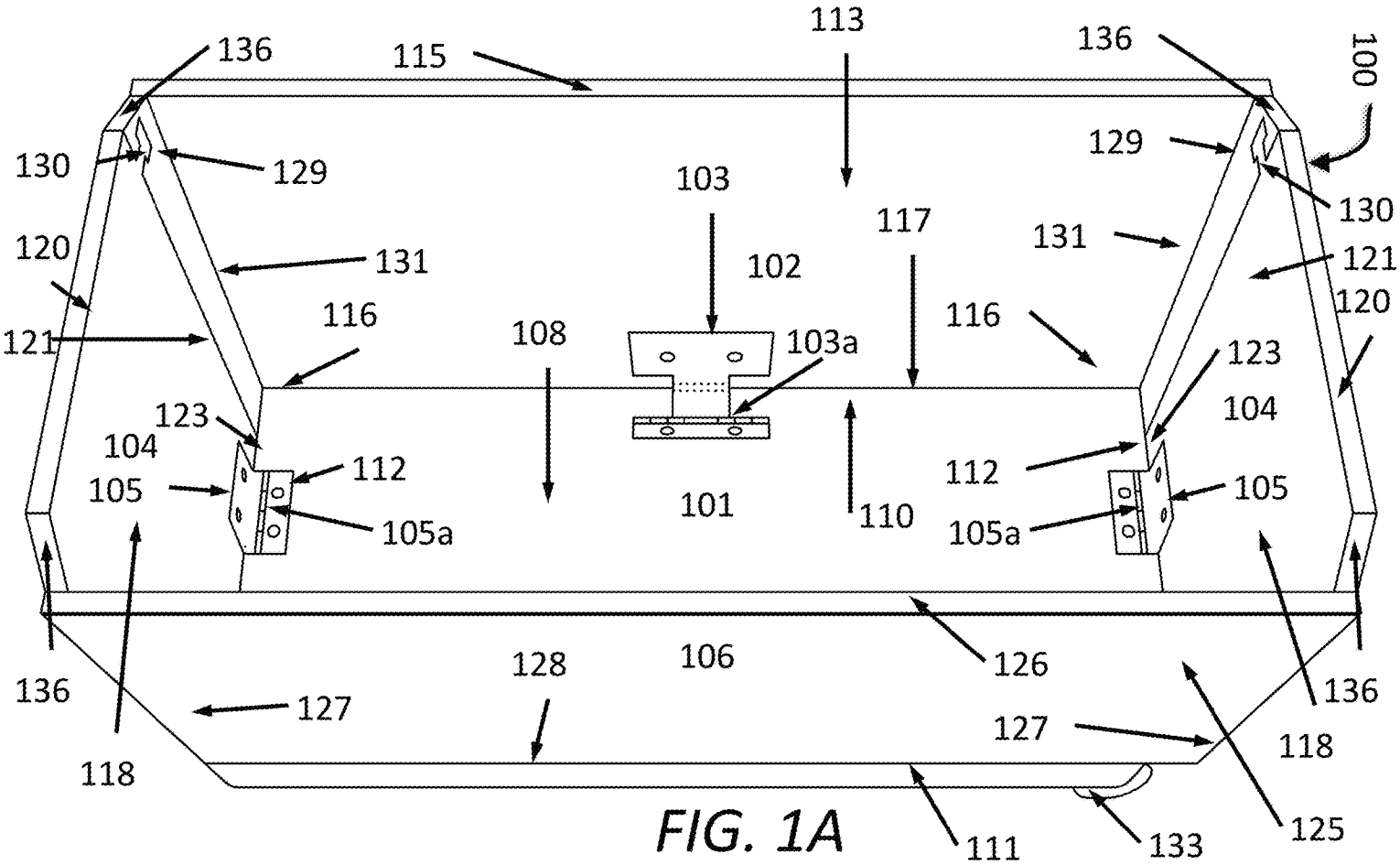
FIG. 1A is a schematic diagram illustrating one embodiment of a collapsible suitcase.

Embodiments of the disclosed suitcase provide travelers with an easily foldable suitcase that is compact when collapsed and rigid and protective when deployed. In some embodiments, the collapsed form of the disclosed suitcase may easily be carried as a satchel, stowed in other luggage items, or stored in a closet for future use. Some embodiments also include a uniquely ergonomic handle for pulling wheeled embodiments, as well as additional pockets for storage and trays to support electronic devices and books for work or entertainment.

FIGS. 1A-1E depict some embodiments of a collapsible suitcase 100. FIGS. 2A-2F illustrate the steps involved in collapsing some embodiments of the suitcase 100; in some embodiments, unfolding or deploying the suitcase involves reversing the steps illustrated in FIGS. 2A-2F. As an overview, some embodiments of the collapsible suitcase 100 include a rigid bottom panel 101, a rigid rear panel 102 connected to the bottom panel 101 by means of at least one rear hinge 103, two side panels 104 each connected to the bottom panel by means of at least one side hinge 105, and one front panel 106 connected to the bottom panel 101 by means of at least one front hinge 107.

Figure 1B:
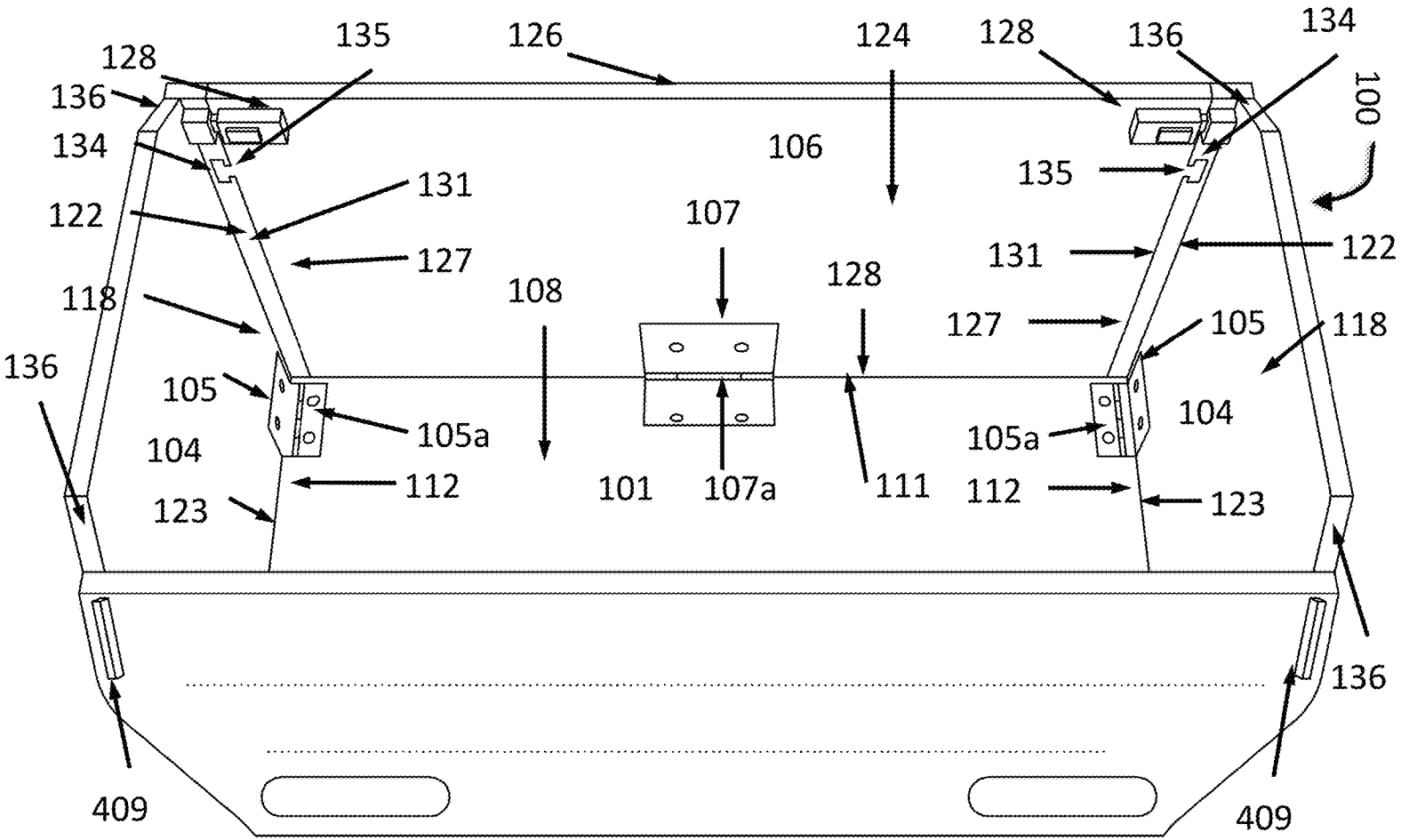
FIG. 1B is a schematic diagram illustrating one embodiment of a collapsible suitcase.
Figure 1C:
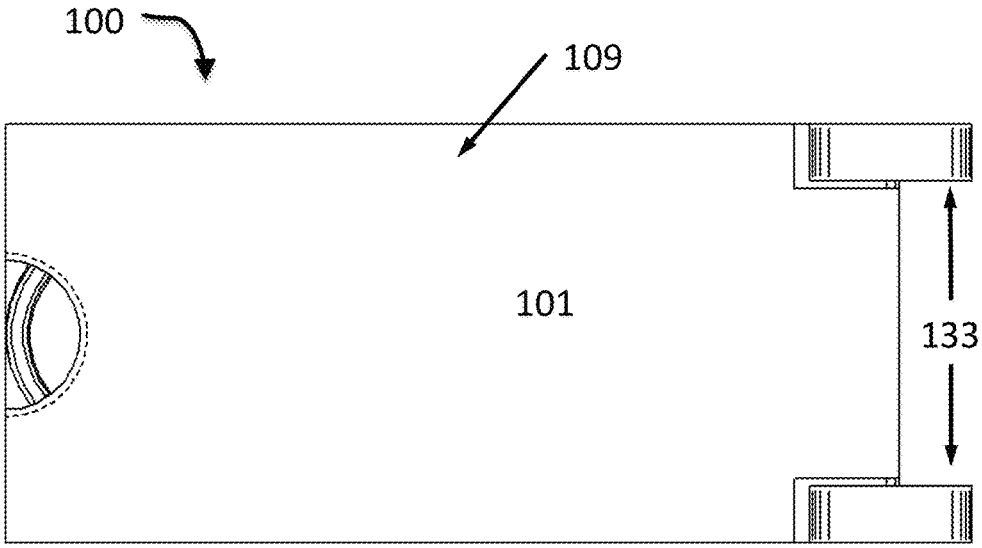
FIG. 1C is a schematic diagram illustrating one embodiment of a collapsible suitcase.
Figure 1D:
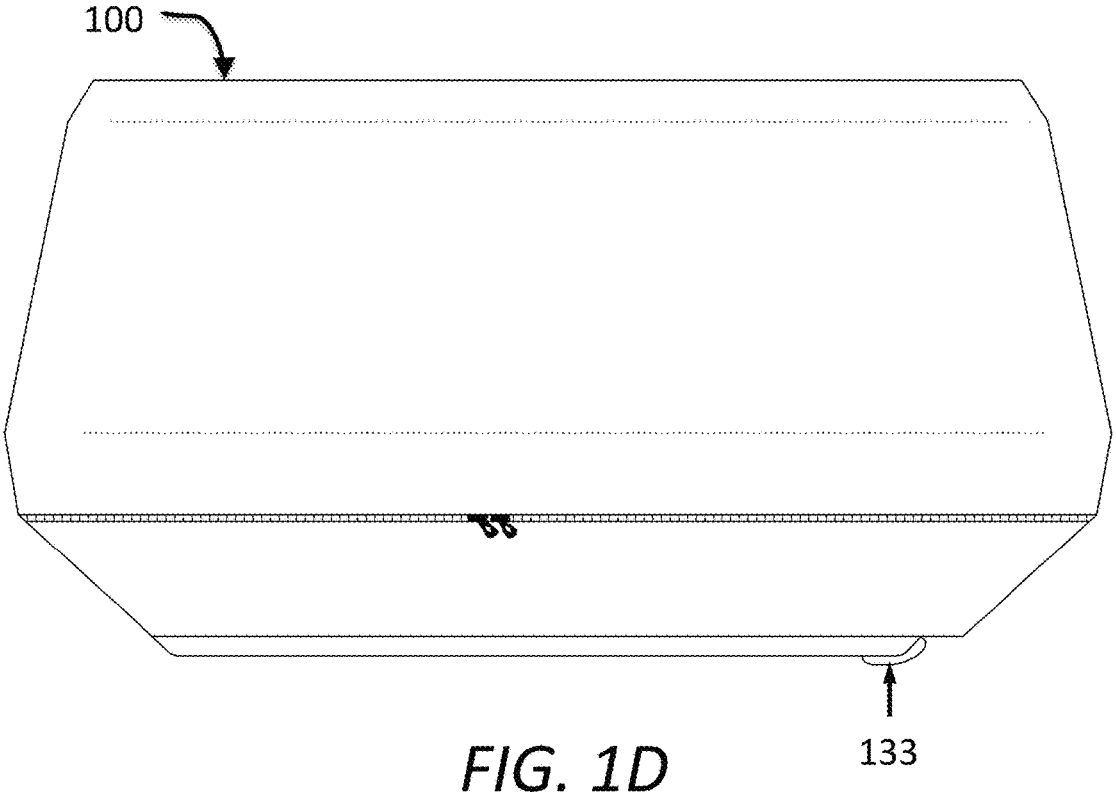
FIG. 1D is a schematic diagram illustrating one embodiment of a collapsible suitcase.
Figure 1E:
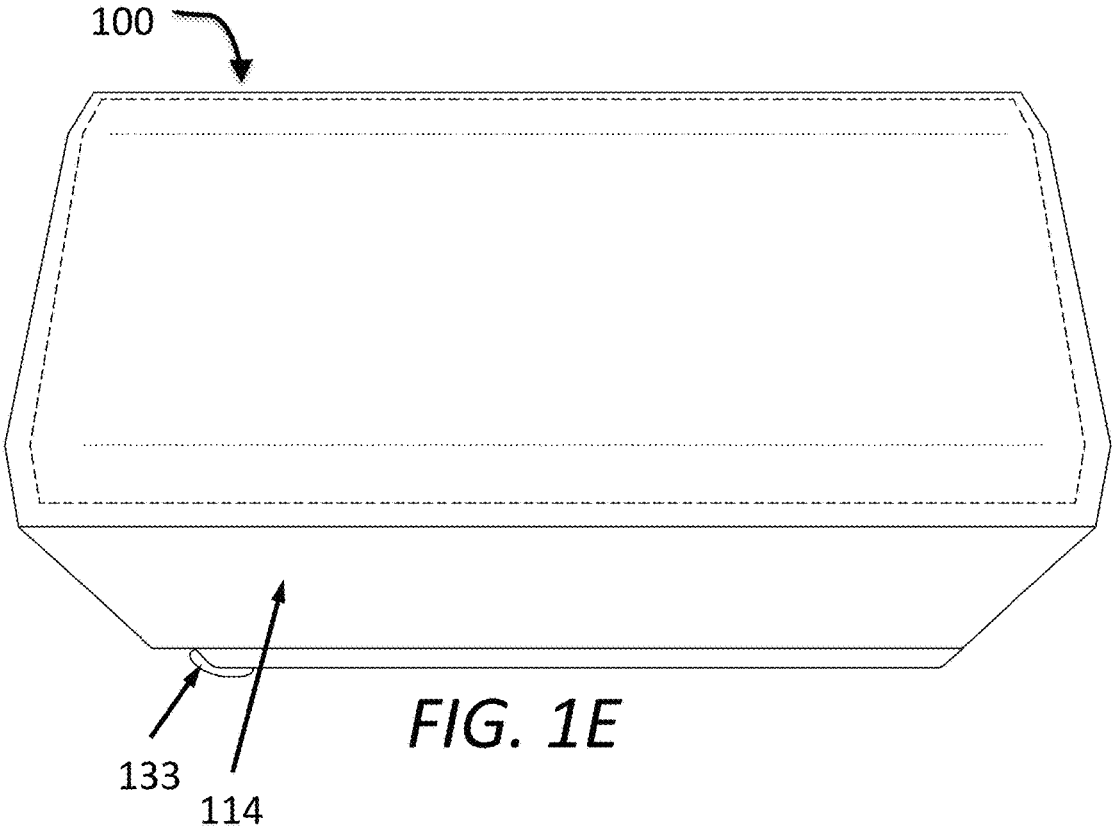
FIG. 1E is a schematic diagram illustrating one embodiment of a collapsible suitcase.

Viewing FIGS. 1A and 1B in further detail, in some embodiments the bottom panel 101 has an interior surface 108, and an exterior surface 109. The bottom panel 101 may be any shape conducive to its use as described herein. The bottom panel 101 may be substantially polygonal; for instance, the bottom panel 101 may be substantially square. The bottom panel 101 may be a substantially regular polygon. The bottom panel 101 may be substantially an irregular polygon; for instance, the bottom panel 101 may be rectangular. The bottom panel 101 may be trapezoidal. The bottom panel 101 may be substantially a combination of polygons. As an example bottom panel 101 may be describable in as a combination of variously sized and formed triangles. The bottom panel 101 may be curved. The bottom panel 101 may be elliptical. The bottom panel 101 may be circular. The bottom panel 101 may be a more complex curved form, such as a bent or irregular ellipse. The bottom panel 101 may be any combination of curved and polygonal forms; for instance, the bottom panel 101 may be rectangular with rounded corners. The bottom panel 101 may be a parabola truncated by at least one straight line. The bottom panel 101 may have indentations in its perimeter. The bottom panel 101 may have protrusions from its perimeter. In some embodiments, the bottom panel 101 is substantially quadrilateral; the bottom panel 101 may, for instance, be a rectangle, trapezoid, or parallelogram with sharp, squared, or rounded corners. In some embodiments, the bottom panel 101 has a rear edge 110. The bottom panel 101 may have a front edge 111. The bottom panel 101 may have two side edges 112. In some embodiments, the bottom panel has additional edges.

The bottom panel may be constructed of any material or combination of materials that make the bottom panel rigid. In some embodiments, the bottom panel 101 is rigid if the bottom panel 101 exhibits only small amounts of displacement relative to the size of the bottom panel 101 when forces typical for the operation of a suitcase act against the interior 108 or exterior 109 surface of the bottom panel 101. For instance, if the suitcase 100 is in its deployed form, as set forth in further detail below, and a person leans on the middle of the exterior surface 109 for support, the person may feel the bottom panel 101 flex only slightly; in some embodiments, the person may be incapable of detecting any displacement of the bottom panel at all. The bottom panel 101 may be constructed of materials including wood. The bottom panel 101 may be constructed of materials including plywood. The bottom panel 101 may be constructed of materials including metal. The bottom panel 101 may be constructed of materials including hard plastic, such as thermosetting plastics, hard thermoplastics such as polyvinyl chloride (PVC), high-density polyethylene (HDPE), polytetraflouroethylene, or hard polypropylene. The bottom panel 101 may be constructed of materials including natural polymers. The bottom panel 101 may include one or more layers of flexible material around the rigid material. The flexible material may include cloth, rubber, or other flexible polymers; the flexible material may be any material suitable for the construction of the exterior cover 400 as described in further detail below. The bottom panel 101 may be composed wholly or in part of flexible material stretched over a rigid frame or mesh. The bottom panel 101 may be composed wholly or partially of fiberglass.

The rear panel 102 may be constructed of any materials or combination of materials suitable for the construction of the bottom panel 101. The rear panel 102 may be any shape suitable for the shape of the bottom panel 101. In some embodiments, the rear panel 102 has an interior surface 113, an exterior surface 114, a top edge 115, two side edges 116, and a bottom edge 117. The at least one rear hinge 103 may allow the rear panel 102 to be rotated between a folded position in which the interior surface 113 of the rear panel is substantially parallel to the interior surface 108 of the bottom panel 101, as shown below in FIG. 2E, and a deployed position in which the interior surface 113 of the rear panel 102 is substantially perpendicular to the interior surface 108 of the bottom panel 101.

The two side panels 104 may be constructed of any materials or combination of materials suitable for the construction of the bottom panel 101. Each side panel 104 may be any shape suitable for the shape of the bottom panel 101. In some embodiments, each side panel 104 has an interior surface 118, an exterior surface 119, a top edge 120, a rear edge 121, a front edge 122, and a bottom edge 123. The at least one side hinge 105 may allow each side panel 104 to be rotated between a folded position in which the interior surface 118 of the side panel 104 is substantially parallel to the interior surface 108 of the bottom panel 101, as shown below in FIGS. 2C-2D, and a deployed position in which the interior surface 118 of the side panel 104 is substantially perpendicular to the interior surface 108 of the bottom panel 101.

The front panel 106 may be constructed of any materials or combination of materials suitable for the construction of the bottom panel 101. The front panel 106 may be any shape suitable for the shape of the bottom panel 101. In some embodiments, the front panel 106 has an interior surface 124, an exterior surface 125, a top edge 126, two side edges 127, and a bottom edge 128. The at least one front hinge 107 may allow the front panel 106 to be rotated between a folded position in which the interior surface 124 of the front panel 106 is substantially parallel to the interior surface 108 of the bottom panel 101, as shown below in FIG. 2B, and a deployed position in which the interior surface 124 of the front panel 106 is substantially perpendicular to the interior surface 108 of the bottom panel 101.

Figure 2A:
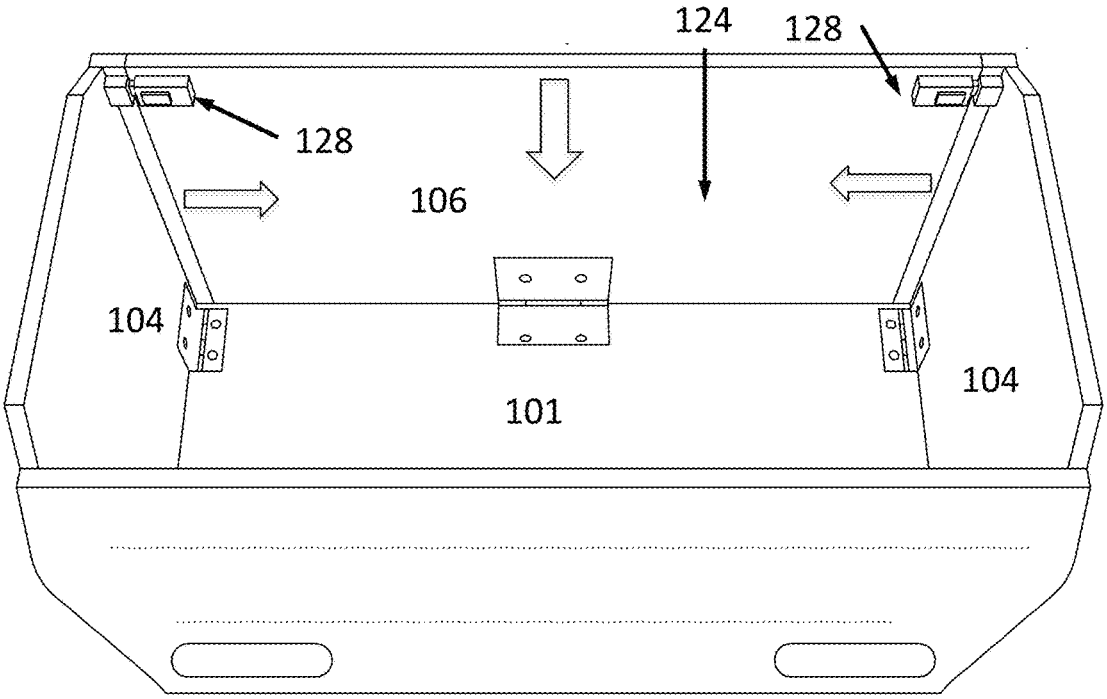
FIG. 2A is a schematic diagram illustrating step in collapsing an embodiment of a collapsible suitcase.

In one embodiment, the suitcase 100 includes at least one latch 128 that secures the front edge 122 of at least one of the side panels 104 to the front panel 106 when the at least one side panel 104 is in deployed position and the front panel 106 is rotated into deployed position. The at least one latch 128 may be constructed of any material or combination of materials suitable for the construction of the bottom panel 101. The at least one latch 128 may have one component attached to one or both side edges 127 of the front panel, and a second component attached to one or both front edges 122 of the side panel 104. The at least one latch 128 may be formed to engage automatically when the front panel 106 is rotated into deployed position between the deployed side panels. As a non-limiting example, the at least one latch 128 may have a spring-biased bolt with an angled end that causes the bolt to retract slightly when an object presses against the bolt in a direction substantially orthogonal to the direction in which the bolt moves, and to be urged back into an extended position in the absence of external pressure, as in a tubular latch for a door. Persons skilled in the art will be aware of many other latches designed to engage automatically. The at least one latch 128 may have a component that enables the user to engage or disengage the at least one latch 128 manually; for instance, the at least one latch 128 may engage automatically when the front panel 106 is swung into deployed position between the two side panels, and remain engaged until a user disengages the at least one latch 128 manually; for instance, as shown in FIG. 2A, the user may disengage each latch 128 prior to folding down the front panel 106 to commence collapsing the suitcase 100. In some embodiments, at least one additional latch (not shown) secures one or both side panels 104 to the rear panel 102 when the rear panel 102 is in deployed position and the one or more side panels 104 are rotated into deployed position.

In some embodiments of the suitcase, 100, at least one side edge of the rear panel includes at least one first engagement member 129, and the rear edge of at least one side panel has a second engagement member 130 that slidably engages the first engagement member 129, fixing the side panel 104 to the rear panel 102, when the rear panel 102 is already in deployed position and the side panel 104 is rotated into deployed position. As an example, one or both of the side edges 116 of the rear panel 102 have one or more protrusions 131 in a direction substantially perpendicular to the interior surface 113 of the rear panel 102; the one or more protrusions 131 may extend from the top edge 115 to the bottom edge 117 of the rear panel 102. Continuing the example, the one or more protrusions 131 may have at least one indentation or slot 129 positioned to engage a corresponding member 130 slidably. Further continuing the example, the rear edge 121 of at least one side panel may have at least one protrusion or tab 130 that slide into the at least one indentation or slot 129 in the at least one protrusion 131 when the rear panel 102 and each side panel 104 are in their unfolded positions. The mutually engaging members may secure the side panels 104 to the rear panel 102; the side panels 104 may be further secured in the deployed position by the at least one latch 128 securing the side panels 104 to the front panel 106, causing the suitcase 100 to present a solid and rigid body when fully deployed. For instance, the front panel 106 may prevent the side panels 104 from rotating out of their deployed positions when the front panel 106 is in its deployed position, causing the engagement members 129, 130 to secure the rear panel in its deployed position, and lending rigidity to the connection between the rear panel 102 and the side panels 104

Figure 2B:
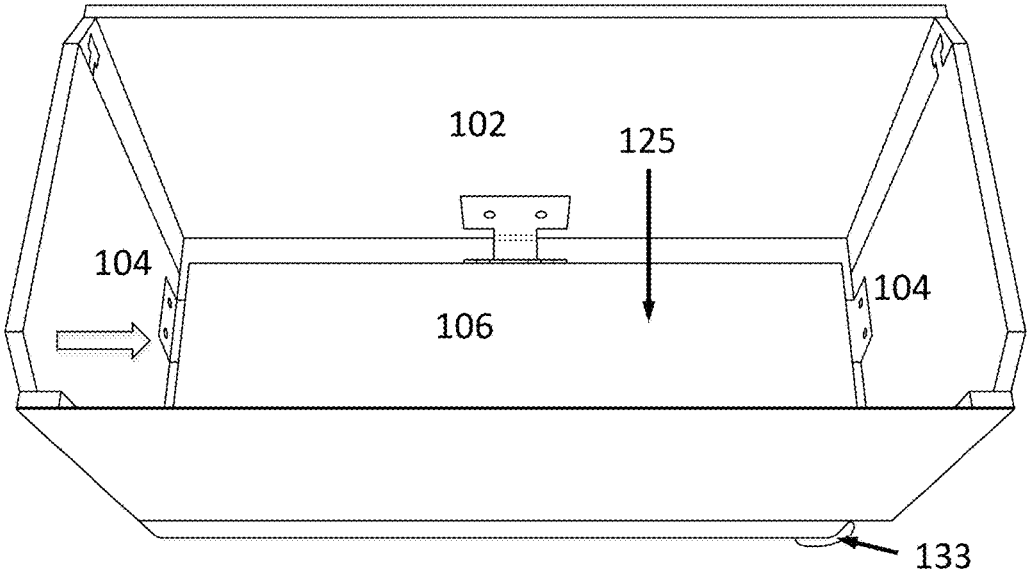
FIG. 2B is a schematic diagram illustrating step in collapsing an embodiment of a collapsible suitcase.
Figure 2C:
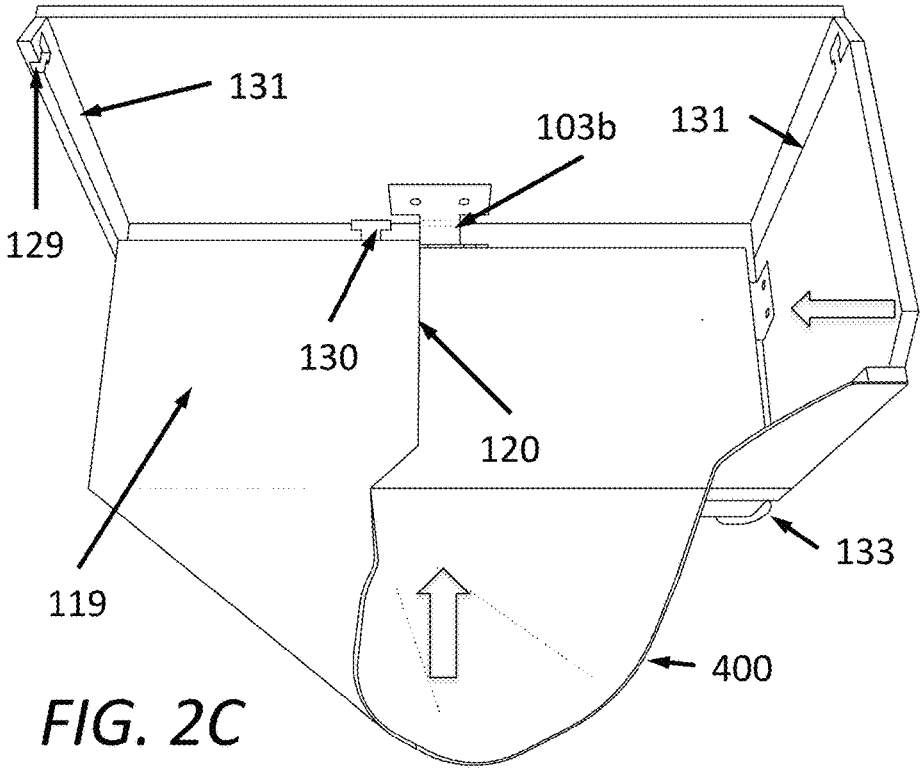
FIG. 2C is a schematic diagram illustrating step in collapsing an embodiment of a collapsible suitcase.
Figure 2D:
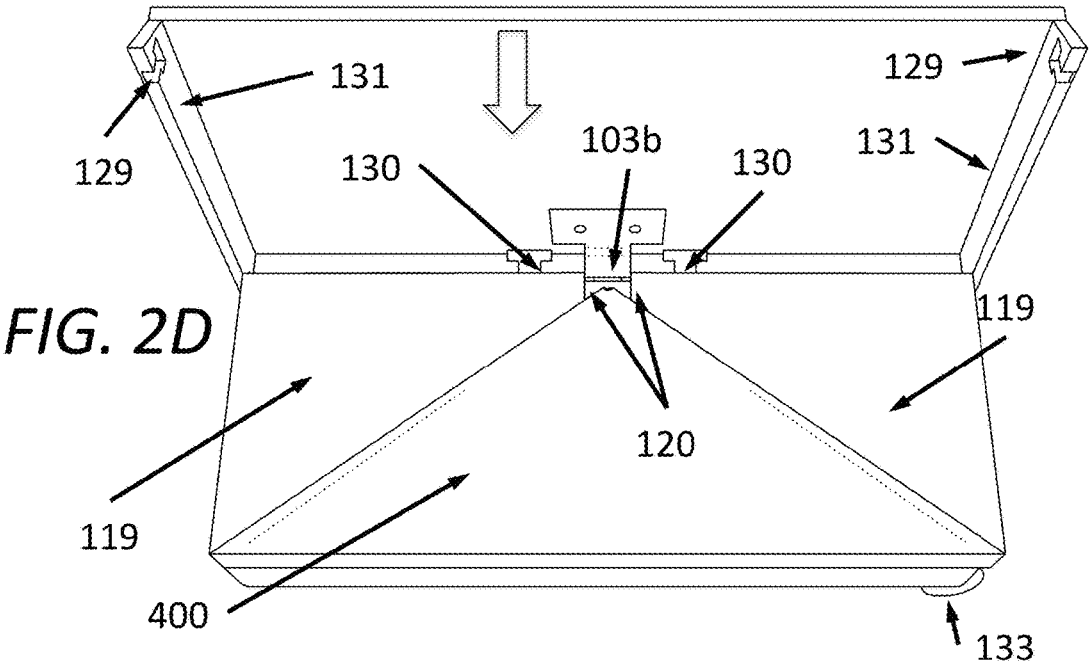
FIG. 2D is a schematic diagram illustrating step in collapsing an embodiment of a collapsible suitcase.

The hinges 103, 105, 107 may be constructed of any material or combination of materials suitable for the construction of the bottom panel 101. The hinges 103, 105, 107 may have progressively larger clearances so that when the panels are folded in a certain order, each panel can rest on top of the previously folded panels in its folded position, substantially parallel to the top surface 108 of the bottom panel 101. For instance, in some embodiments, the at least one front hinge 107 has a first clearance permitting the interior surface 124 of the front panel 106 to rest on the interior surface 108 of the bottom panel 101 when the front panel 106 is in folded position, as shown in FIG. 2B; for instance, the at least one front hinge 107 may have a pivot point 107*a* at or very close to the juncture of the bottom edge 128 of the front panel 106 and the front edge 111 of the bottom panel 101. The at least one side hinge 105 of each side panel 104 may have a larger clearance to fit the side panel 104 over the front panel 106 when the front panel 106 is in its folded position; for instance, each of the at least one side hinges 105 may have a second clearance sufficiently larger than the first clearance to allow the interior surface 118 of the side panels 104, when in folded position, to rest on top of the exterior surface 125 of the front panel 106 when the front panel 106 is in folded position. As an example, the pivot 105*a* of the least one side hinge 105*a* may be offset from the junction of the bottom edge 123 of each side panel 104 and the corresponding side edge 112 of the bottom panel 101; the offset may be substantially the same as the thickness of the front panel 106. In some embodiments, the two side panels overlap each other in folded position; in that case, one of the two side panels may have a hinge with a third clearance (not shown) permitting the interior surface 118 of that side panel 104, when in folded position, to rest on top of the exterior surface 119 of the other side panel 104 when the other side panel 104 is in folded position. For instance, the offset of the hinge of one side panel 104 may be greater than the offset of the hinge of the other side panel The at least one rear hinge 103 may have a larger clearance than that of the at side hinges 105 to fit the rear panel over the folded side panels 104 when the rear panel 102 is moved into its folded position; for example, in some embodiments, the at least one rear hinge 103 has a third clearance sufficiently larger than the second clearance to allow the interior surface 113 of the rear panel 102, when in folded position, to rest on top of the exterior surfaces 119 of the side panels 104 when the side panels 104 are in folded position. The at least one rear hinge 103 may have a pivot point 103*a* that is further offset from the juncture of the bottom edge 117 of the rear panel 101 and the rear edge 110 of the bottom panel 101 than the offset of the side hinges 105. The offset may be substantially the same as the combined thickness of the front and side panels when folded together, or slightly larger to accommodate folds of the exterior covering 400, described in further detail below. The offset of the rear hinge 103 may be greater if the side panels 104 overlap each other when folded, as described above. In some embodiments, as shown in FIGS. 2C-D, the top edges 120 of two side panels do not meet in the middle of the suitcase 100 when the two side panels 104 are in folded position, resulting in a gap between the two side panels' top edges 120; the rear hinge 103 may have a narrow central portion 103*b* to allow the rear hinge to pass between the top edges 120 of two side panels.

In some embodiments, at least one side panel 104 has at least one projection 132 at the front edges 122. The at least one projection 132 may be substantially orthogonal to the plane of the interior surface 118 of the at least one side panel 104. In some embodiments, the at least one projection 132 allows the side edges 127 of the front panel 106 to fit snugly against the at least one projection 132 while being slightly inset from the side edges 112 of the bottom panel 101, allowing greater freedom of movement for the at least one hinge 105 of the side panels 104 when the side panels 104 rotate into folded position. Likewise, the at least one projection 131 of rear panel 102 may enable the rear edges 122 of the side panels 104 to be slightly inset from the rear edge 111 of the bottom panel 102, allowing the bottom panel 102 to swing over the side panels 104 when being rotated into folded position. The top edge 126 of the front panel 106 may line up with the rear edges 122 of the side panels 104 when the front panel 106 is in folded position. The corners of the suitcase formed by the panels 101, 102, 104, 106 may be sharp or rounded, depending on the shapes of the panels, engagement members, and extensions. In some embodiments, the front edge 122 at least one of the side panels 104 has a third engagement member 134, and the corresponding at least one side edge 127 of the front panel 106 has a fourth engagement member 135 that slidably engages the first engagement member 134, fixing the front panel 106 to the at least one side panel 104, when the at least one side panel 104 is already in deployed position and the front panel 106 is rotated into deployed position. This may be implemented as described above for the first 129 and second 130 engagement members in reference to FIG. 1A.

Figure 3:
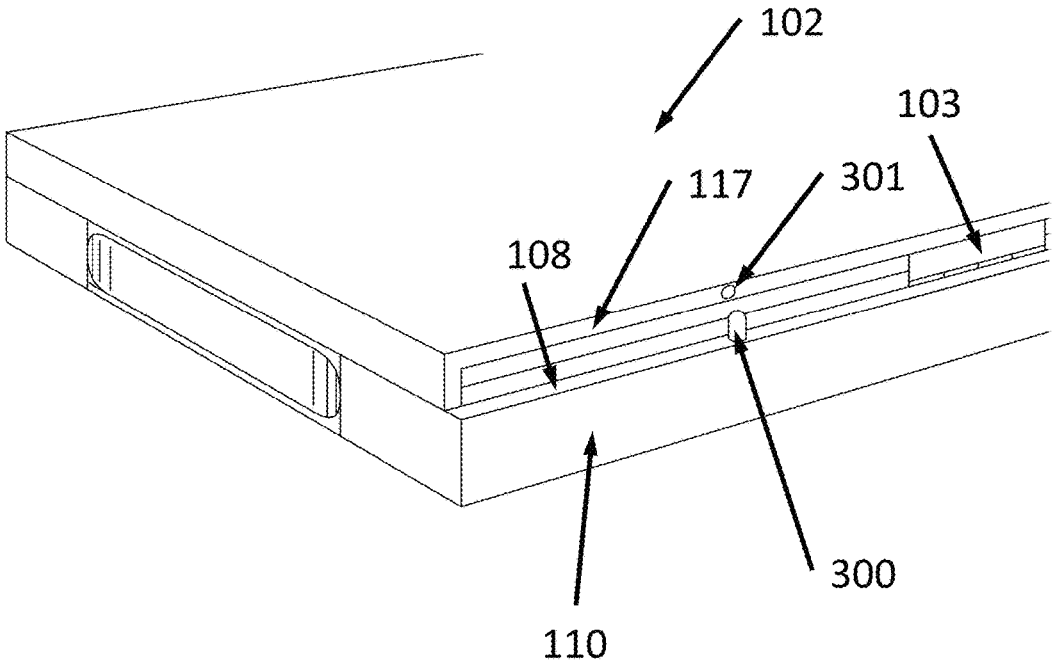
FIG. 3 is a schematic diagram illustrating one embodiment of a supplemental support mechanism used in a collapsible suitcase.

In some embodiments, as shown in FIG. 3, the suitcase 100 includes one or more additional structural elements to increase the strength of the suitcase 100 when deployed. For example, the bottom panel 101 may have at least one peg 300 set perpendicularly to the interior surface 108 of the bottom panel 101 where the bottom edge of the back panel 102, side panel 104, or front panel 106 contacts the interior surface 108 of the bottom panel 101 when deployed, for insertion in a corresponding hole in the bottom edges; for instance, as shown in FIG. 3, the at least one peg 300 may be located on the portion of the interior surface 108 of the bottom panel 101 where the bottom edge 117 of the rear panel 102 contacts the interior surface 108 when the rear panel 102 is deployed. Some embodiments include at least one hole 301 in the bottom edge of the back panel, side panel, or front panel, the at least one hole positioned to pass over the at least one peg when the rear panel, side panel, or front panel is rotated into deployed position. Continuing the example, the bottom edge 117 of the rear panel 102 may have at least one hole 301 positioned to pass over the at least one peg 300 when the rear panel 102 is rotated into deployed position.

In some embodiments, the suitcase 100 has one or more wheels 133. In some embodiments, the suitcase 100 has a first wheel 133 at the corner formed by the rear edge 110 of the bottom panel 101 and a side edge 112 of the bottom panel 101, and a second wheel 133 at the corner formed by the same side edge 112 of the bottom panel 101 and the front edge 111 of the bottom panel 101. In other embodiments, the suitcase has four or more wheels. The wheels 133 may be oriented in a fixed direction relative to the suitcase 100. The wheels 133 may be mounted on pivots; for instance, the suitcase 100 may have four wheels attached to the corners of the bottom panel 101, a side panel 104, the front panel 106 or the rear panel 102. The one more or wheels 133 may be constructed of any material or combination of materials suitable for the construction of the bottom panel 101.

In some embodiments, the suitcase 100 has an exterior covering 400. In some embodiments, the exterior cover 400 is flexible. The exterior cover 400 may be constructed entirely of flexible materials. The exterior cover may 400 may include one or more rigid portions; for instance, the exterior cover 400 may include one or more rigid panels (not shown) joined to one another. The rigid panels may be joined by flexible sections; for instance, the rigid panels may be joined by strips or sections of flexible material (not shown); the rigid panels may be contained in pockets in a flexible material covering the entire external covering 400. The rigid panels may be constructed of any material or combination of materials suitable for the construction of the bottom panel 101. In some embodiments, the exterior cover 400 is made wholly or in part of flexible material. The flexible material may be textile material; the textile material may include natural fibers. The natural fibers may include plant material, such as cotton, linen, hemp, or manila hemp; for example, the flexible material may be a woven product such as canvas. The natural fibers may include animal fibers such as wool or silk. The flexible material may include synthetic fibers, including fibers made from synthetic polymers, such as nylon and polypropylene. The flexible material may include fibers made from natural materials, such as rayon. The flexible material may include leather. The flexible material may include one or more sheets of natural polymers, such as rubber. The flexible material may include one or more sheets of synthetic polymers, such as flexible plastics.

In some embodiments, the flexible material is flexible along one axis, but not along another. For instance, the flexible material may include many closely-placed thin but long rigid substantially parallel strips or rods stuck to a flexible material, with sufficient space between the strips or rods to allow the material to flex along an axis substantially parallel to the strips; the strips or rods may prevent the flexible material from bending along any axis having a substantial component orthogonal to the direction of the strips or rods. The strips or rods may be rigid as defined above in for the bottom panel 101 in reference to FIGS. 1A-2F.

The exterior covering may include a first portion 400*a* fixed to the exterior surface 119 of each side panel 106 and connecting the front edges 122 of the two side panels to each other, so that the exterior surface 125 of the front panel 106 rests against the first portion 400*a* when the front panel 106 is in deployed position; in other words, the first portion 400*a* of the exterior covering 400 may wrap around the front and sides of the suitcase 100. In one embodiment, the exterior cover 400 or any portions thereof may be fixed to the exterior surface of a panel if the exterior cover 400 covers substantially all of the exterior surface of the panel both when the panel is folded and deployed; the exterior cover may be adhered or fastened to the exterior surface of the panel. The exterior cover may have a pocket or sleeve containing the panel; the panel may be sewn between layers of the exterior cover 400. The first portion 400*a* may have a first perimeter edge 401 against the bottom edge 123 of both of the side panels 104 and against the front edge 111 of the bottom panel 101 and a second perimeter edge 402 against the rear edge 121 of each side panel 104, the top edge 120 of each side panel, and the top edge 126 of the front panel 106 when the front panel 106 is in deployed position. The exterior covering 400 may include a second portion 400*b* fixed to the exterior surface 109 of the bottom panel 109 and fixed to the exterior surface 114 of the rear panel 102. In some embodiments, the second portion 400*b* may have a first perimeter edge 403 fixed to the first perimeter edge 401 of the first portion 400*a*, a second perimeter edge 404 against one side edge 116 of the rear panel 102, and a third perimeter edge 405 against the other side edge 116 of the rear panel 102. The first portion 400*a* and second portion 400*b* may or may not represent the physical sections assembled to create the exterior covering 400 in practice. In some embodiments, the first portion 400*a* and second portion 400*b* are made separately and fixed together, for instance by sewing the first perimeter edge 401 of the first portion 400*a* to the first perimeter edge 403 of the second portion 400*b*. In other embodiments, the exterior covering 400 is made of more sections attached together by sewing or other means; the divisions between sections may not correspond to divisions between the second portion 400*b* and the first portion 400*a*. In some embodiments, the exterior covering is constructed as a monolithic whole; for instance, the exterior covering 400 may be made as a cross-shaped sheet with its center sized to cover the exterior surface 109 of the bottom panel, and arms sized to cover the side panels 104, rear panel 102, and front panel 106, to be sewn or otherwise attached together at the corner of the front panel 106 with the side panels 104. Persons skilled in the art will be aware of other methods of construction and design that may be substituted for those described here to create the exterior covering 400 as described herein. In some embodiments, where the exterior covering 400 is flexible around only one set of parallel axes, the axes are arranged in the first portion 400*a* in a direction running from the bottom edge to the top edge of each side panel and the front panel. In some embodiments, the exterior covering 400 near to a hinge is flexible along an axis parallel to the axis of rotation of that hinge.

In some embodiments, the second portion 400*b* includes a lid 406 that may be folded to a closed position covering an opening in the suitcase 100 bordered by the top edge 115 of the rear panel 102, the top edge 120 of each side panel 104 and the top edge 126 of the front panel 106, when the rear panel 102, the side panels 104, and the front panel 106 are in deployed position. The lid 406 may have any shape sufficient to cover the opening. The lid 406 may be secured to the opening by a zipper 407. The zipper 407 may have a first half 407*a* that covers the second perimeter 402 of the first portion 400*a* and a second half 407*b* covering the second perimeter edge 404 of the second portion 400*b*, a portion of the lid 406 that contacts the second perimeter 403 of the first portion 400*a* when the lid 406 is in the closed position, and the third perimeter edge 405 of the second portion. Thus, the zipper 407 may run up one side edge 116 of the rear panel 202, along the top edge 120 of the adjacent side panel 104, along the edge of the first portion 400*a* that is adjacent to the top edge 126 of the front panel 106, along the top edge 120 of the next side panel 104, and back down the second side edge 116 of the rear panel 102. As a result, the zipper 407 may function both to secure the lid 406 in a closed position and to secure the second perimeter edge 404 and third perimeter edge 405 of the second portion 400*b* to the second perimeter edge 402 of the first portion 400*a*. In some embodiments, the zipper 407 adds additional strength to the suitcase 100 when the zipper 407 is closed. In some embodiments, the zipper 407 has two sliders 408*a-b*; as a result, the lid 406 may be disengaged from the opening of the suitcase 100 and opened, while the portions of the zipper 407 holding together the second 404 and third 405 perimeter edges of the second portion 400*b* to the second perimeter edge 402 of the first portion 400*a* remain fastened. The zipper 407 may be any form of slide fastener. In other embodiments, at least one alternative fastener is used to hold the second 404 and third 405 perimeter edges of the second portion 400*b* to the second perimeter edge 402 of the first portion. The at least one alternative fastener may be any set of fasteners that fastens the second 404 and third 405 perimeter edges of the second portion 400*b* to the second perimeter edge 402 of the first portion 400*a*, including without limitation hook-and-loop fasteners, snaps, buttons, buckles, and ties.

Figure 2E:
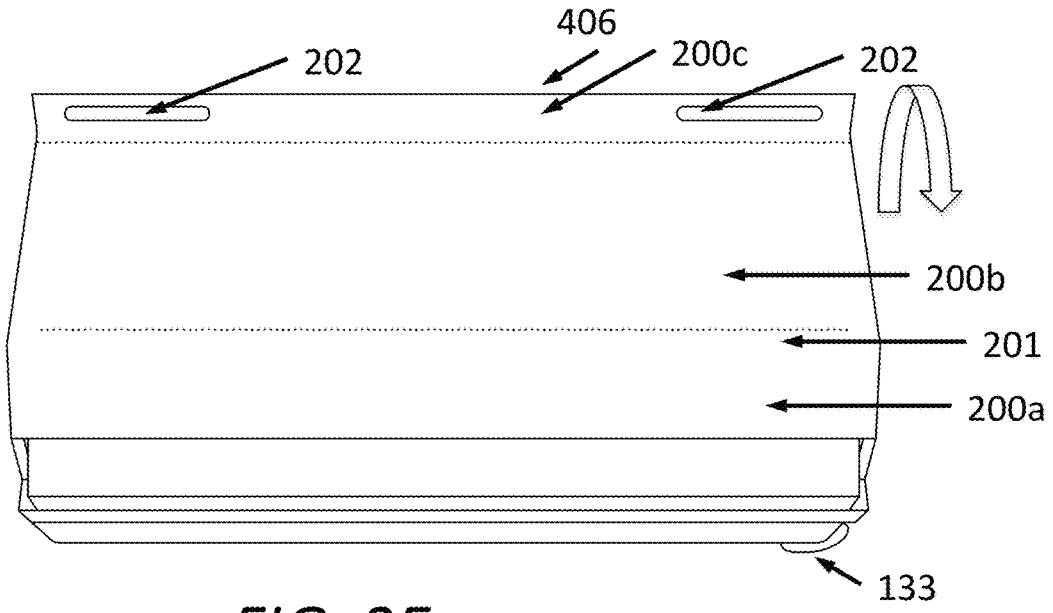
FIG. 2E is a schematic diagram illustrating step in collapsing an embodiment of a collapsible suitcase.
Figure 2F:
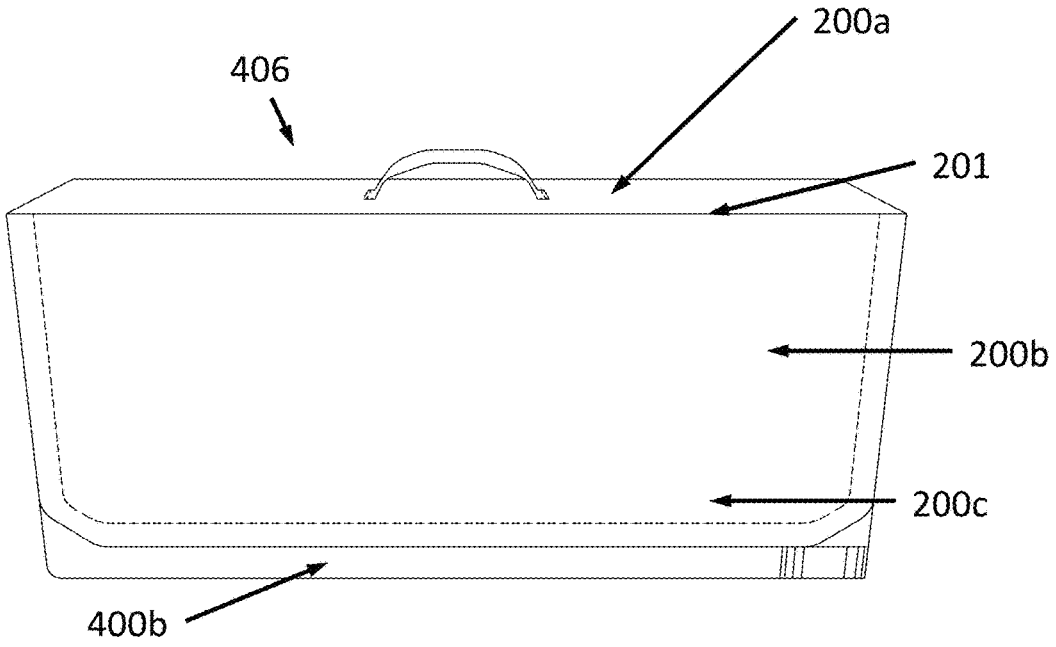
FIG. 2F is a schematic diagram illustrating step in collapsing an embodiment of a collapsible suitcase.

In some embodiments, as shown in FIG. 2E, the lid 406 includes at least one rigid panel 200*a-c*. The at least one rigid panel 200*a-c* may cause the lid 406 to present a substantially rigid surface when closed, according to the definition of rigidity described above for the bottom panel 101 in reference to FIGS. 1A-1E. In some embodiments, the at least one rigid panel further includes a first panel 200*a* and a second panel 200*b* separated by a flexible portion 201, so that the lid 406 may be wrapped around the suitcase 100 when the front panel 106, side panels 104, and rear panels 102 are in folded position, as shown in FIG. 2F. In some embodiments, the lid 406 includes at least one fastener 202 that fastens the lid 406 to the second portion 400*b* at the exterior surface 109 of the bottom panel 101 of the suitcase 100 when the lid 406 is wrapped around the suitcase 100. The at least one fastener 202 may be any fastener suitable for fastening one surface to another, including but not limited to a hook-and-loop fastener, a buckle such as a slide-release buckle, tension lock, or frame buckle, a snap, a button, or a tie. In some embodiments, the at least one fastener 202 also fastens the lid 406 to the first portion 400*a* at the exterior surface 125 of the front panel 106 when the lid 406 is in the closed position and the front panel 106, is in deployed position.

In some embodiments, as is shown in FIGS. 1A-1B, each of the distance from the top edge 115 of the rear panel 102 to the to the interior surface 108 of the bottom panel 101 and the distance from the top edge 126 of the front panel 106 to the interior surface 108 of the bottom panel 101 is less than the distance from the top edge 120 of each side panel 104 to the interior surface 108 of the bottom panel 101, and the at least one rigid panel 200*a-c* of the lid 406 includes a central panel 200*b* that has a front edge 203 and a rear edge 204, occupying a position at the height of the top edges 120 of the two side panels 104 and substantially parallel to the interior surface 108 of the bottom panel 101 when the lid 406 is in its closed position, a forward panel 200*c* that slants down from the front edge 203 of the central panel 200*b* to the top edge 126 of the front panel 106 when the lid is in the closed position, and a back panel 200*a* that slants down from the back edge 204 of the central panel to the top edge 115 of the rear panel 102 when the lid is in the closed position. The suitcase may include one or more slanting top edges 136 that connect the higher top edges 120 of the side panels 104 to the lower top edges 115, 126 of the front panel 106 and the rear panel 102. The forward 200*c* and back 200*b* panels of the lid 406 may rest on the slanting top edges 136 when the lid 406 is closed. In some embodiments, the joint between the back panel 200*c* and the central panel 200*a* is in a state of elastic equilibrium when the lid 406 is in a closed position; as a result the joint is 201 is biased to allow the lid 406 to fold over the suitcase 100 with less resistance when the suitcase 100 is in its collapsed position. As an example, where the lid 406 is made up of two flexible layers with the central panel 200*b*, back panel 200*a*, and front panel 200*c* sandwiched between the two flexible layers, the flexible layer that faces the interior surface of the bottom panel when the lid 406 is in its closed position may have a slightly smaller surface area than the flexible layer that is on top of the suitcase 100 when the lid 406 is in its closed position.

Figure 4A:
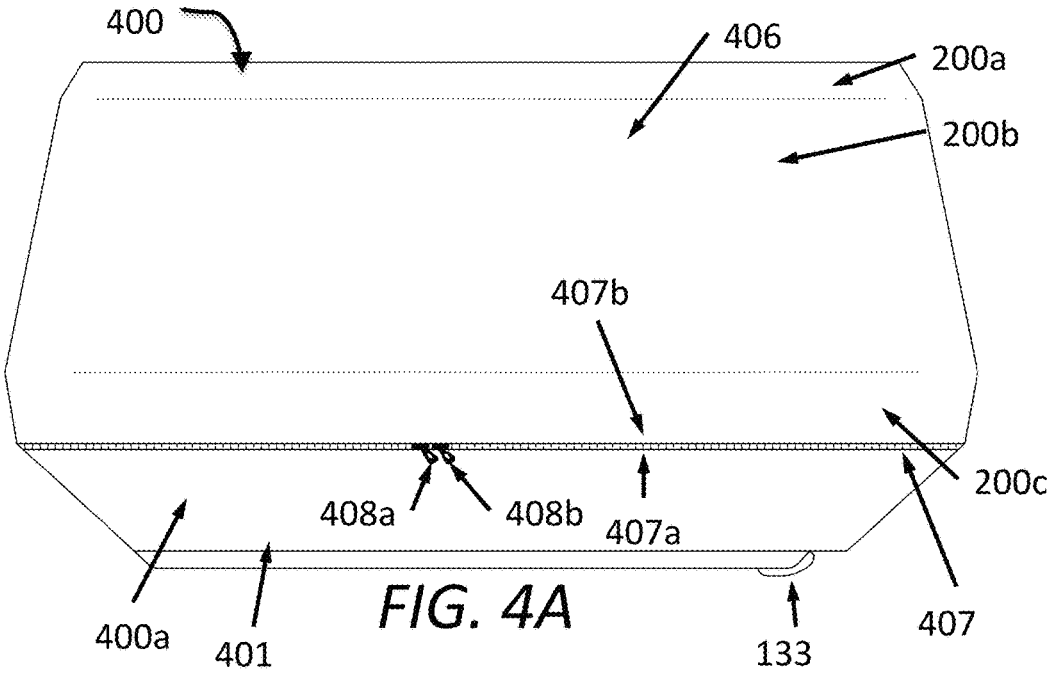
FIG. 4A is a schematic diagram illustrating an exterior covering of an embodiment of a collapsible suitcase.
Figure 4B:
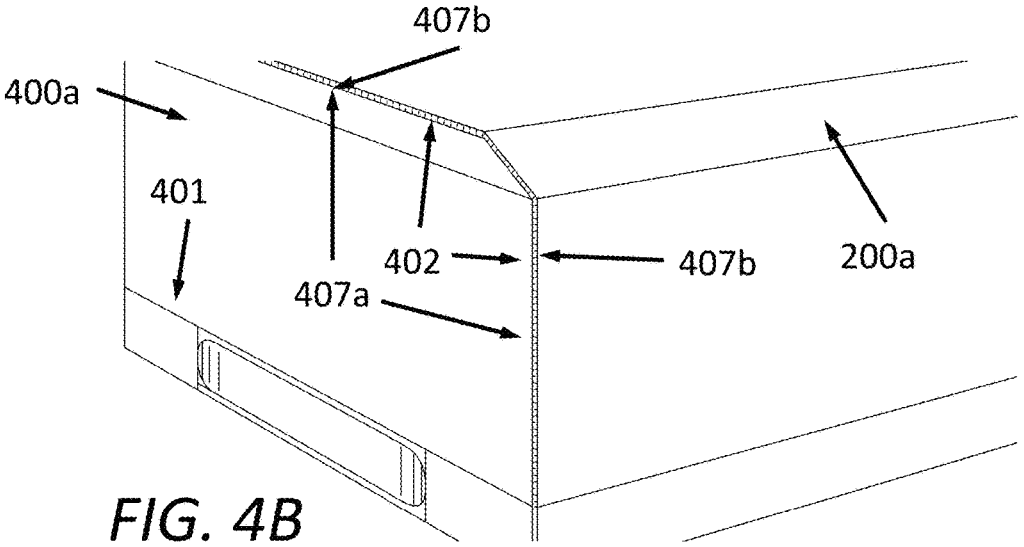
FIG. 4B is a schematic diagram illustrating an exterior covering of an embodiment of a collapsible suitcase.
Figure 4C:
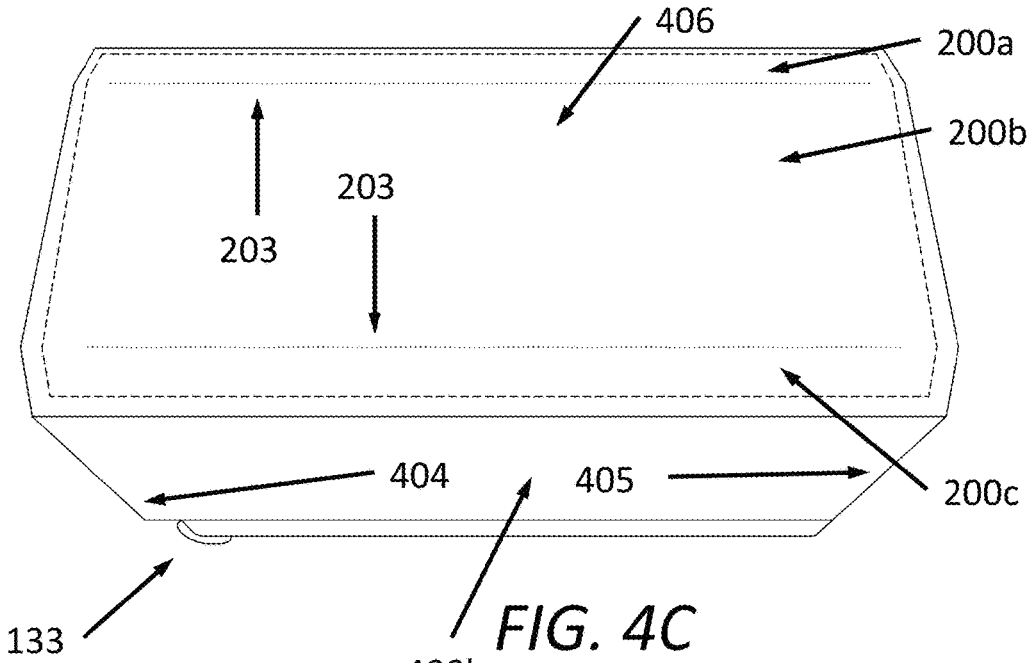
FIG. 4C is a schematic diagram illustrating an exterior covering of an embodiment of a collapsible suitcase.
Figure 4D:
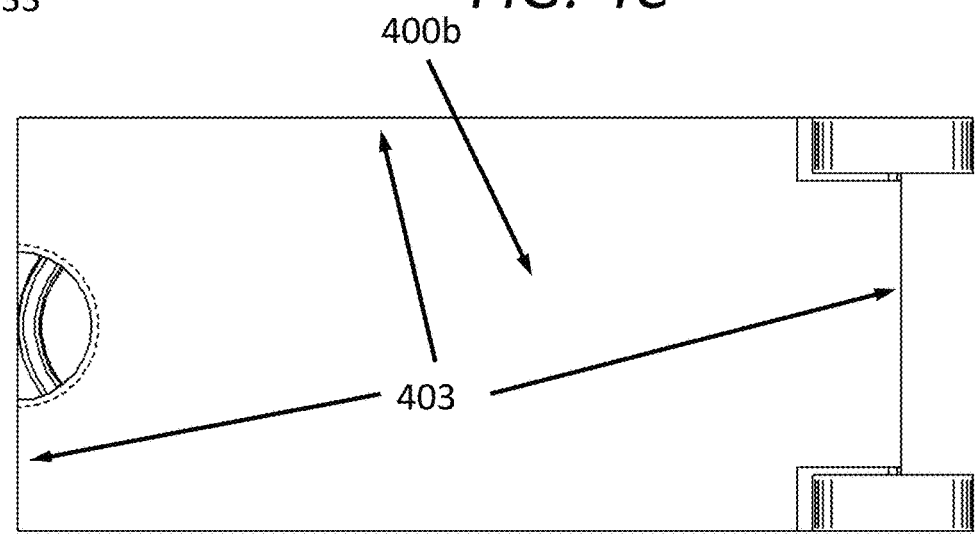
FIG. 4D is a schematic diagram illustrating an exterior covering of an embodiment of a collapsible suitcase.
Figure 4E:
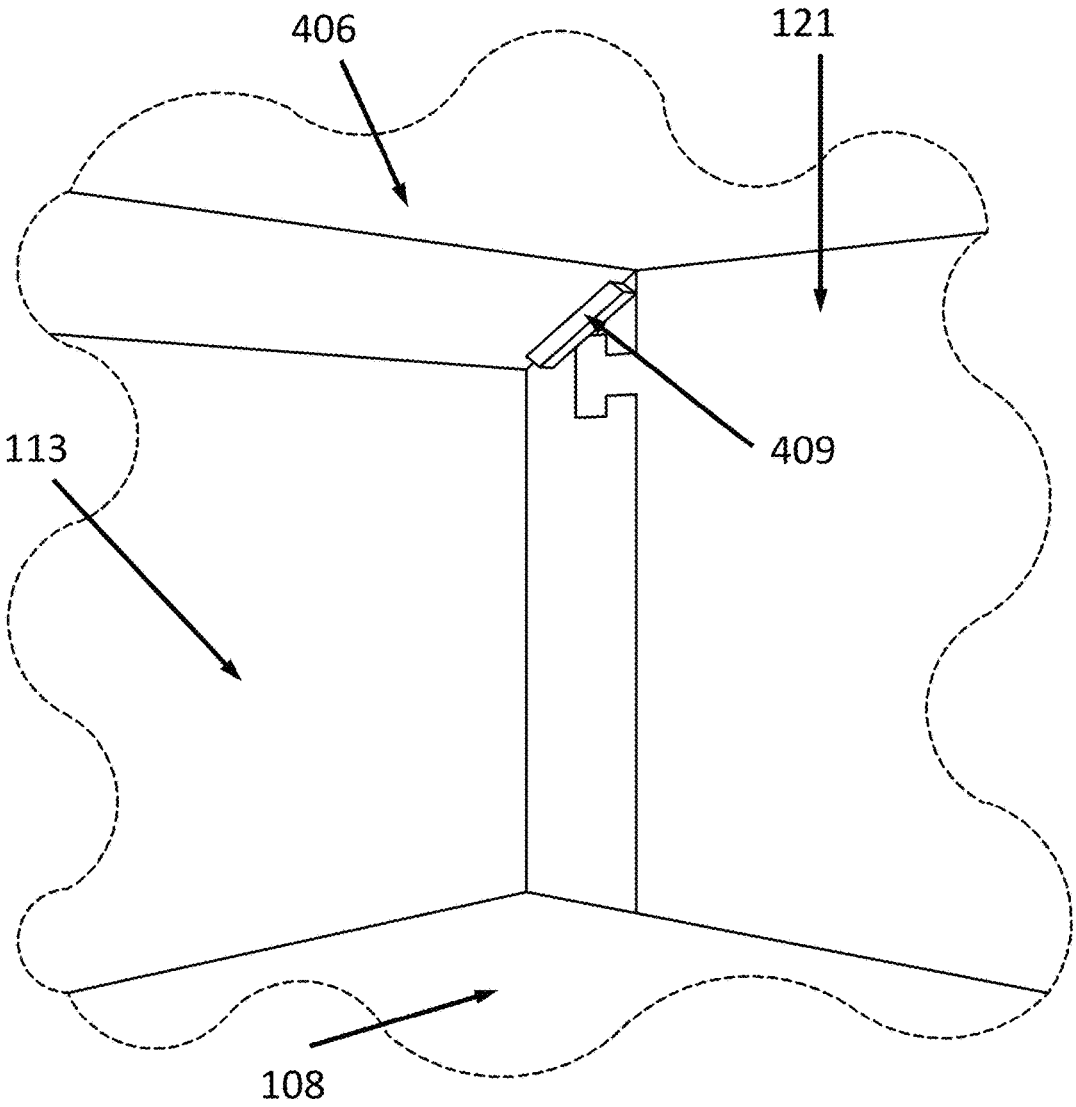
FIG. 4E is a schematic diagram illustrating a detail of a lid of an embodiment of a collapsible suitcase.

In some embodiments, as shown in FIGS. 4E and 1B, the lid 406 includes at least one projection 409 that rests against at least one of the interior surface 113 of the rear panel 102, the interior surface 118 of at least one side panel 104, or the interior surface 124 of the front panel 106 when the lid 406 is in the closed position. In some embodiments, the at least one projection 409 is a lip or ledge extending downward from the underside of the lid 406. The lip or ledge may be parallel to the edge of the lid 406. In some embodiments, the lip or ledge extends for the length of each of the interior surface 113 of the rear panel 102, the interior surface 118 of each of the side panels 104, and the interior surface 124 of the front panel 106. In other embodiments, the lip or ledge extends for the length of each of the interior surface 118 of each of the side panels 104, and the interior surface 124 of the front panel 106. In additional embodiments, the lip or ledge extends for the length of the interior surface 124 of the front panel 106. In additional embodiments, the lip or ledge extends for the length of the interior surface 118 of at least one of the side panels 104. In other embodiments, the lip or ledge extends for the length of the interior surface 113 of the rear panel 102. The lip or ledge may cover only part of the length of the interior surface of one or more panels; as a non-limiting example, the at least one projection 409 may include one lip or ledge that rests against a part of the interior surface 118 of one side panel 104 and a second lip or ledge that rests against a part of the interior surface 118 of the other side panel. In some embodiments, the at least one projection 409 adds strength and stability to the suitcase 100 when the lid 406 is closed, by bracing against the interior surface of one or more panels. The at least one projection 406 may have any shape that accomplishes that purpose, including one or more dowels, wedges, or tabs.

Figure 5A:
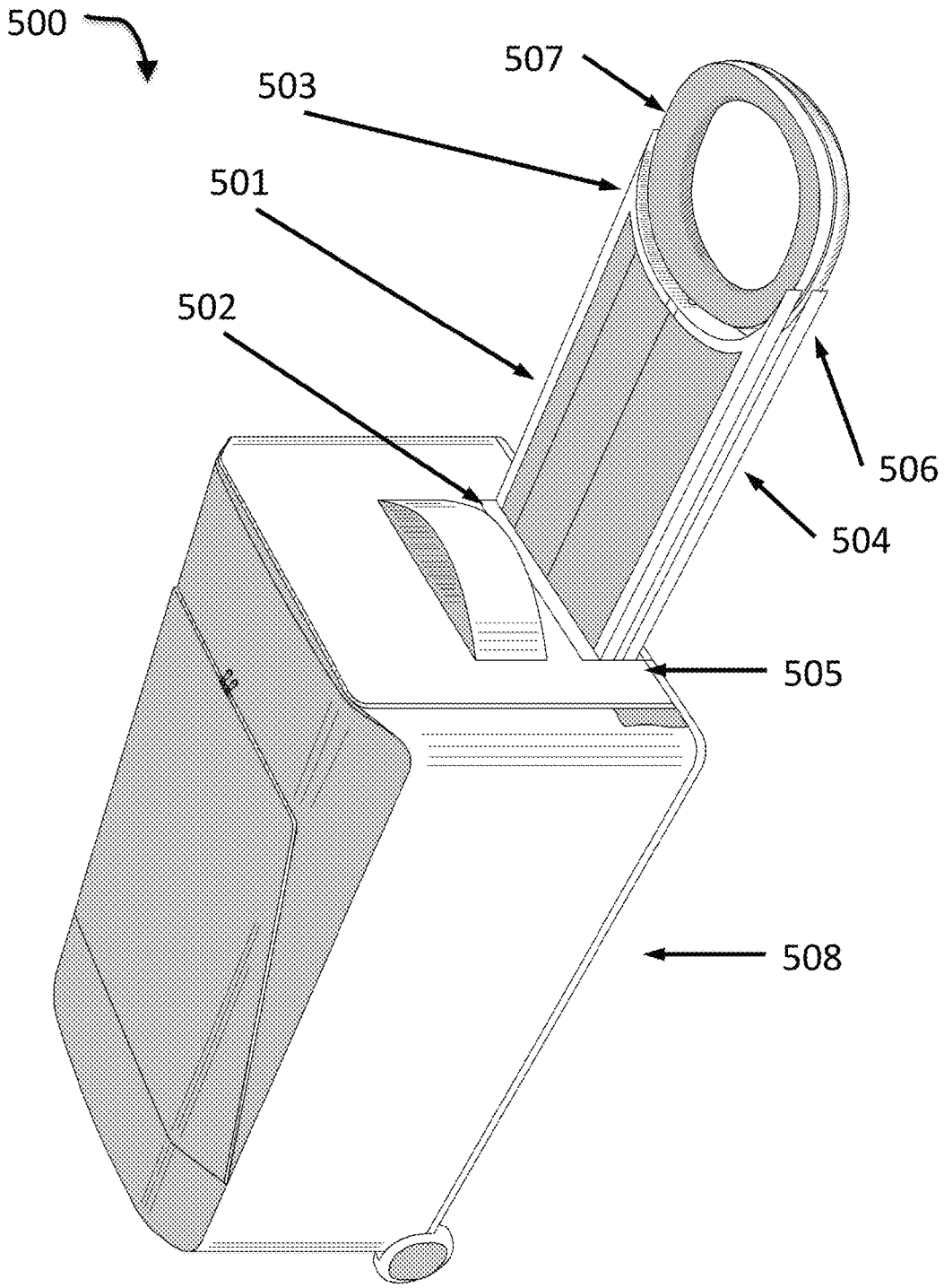
FIG. 5A is a schematic diagram illustrating one embodiment of an extension handle attached to an item of luggage.
Figure 5B:
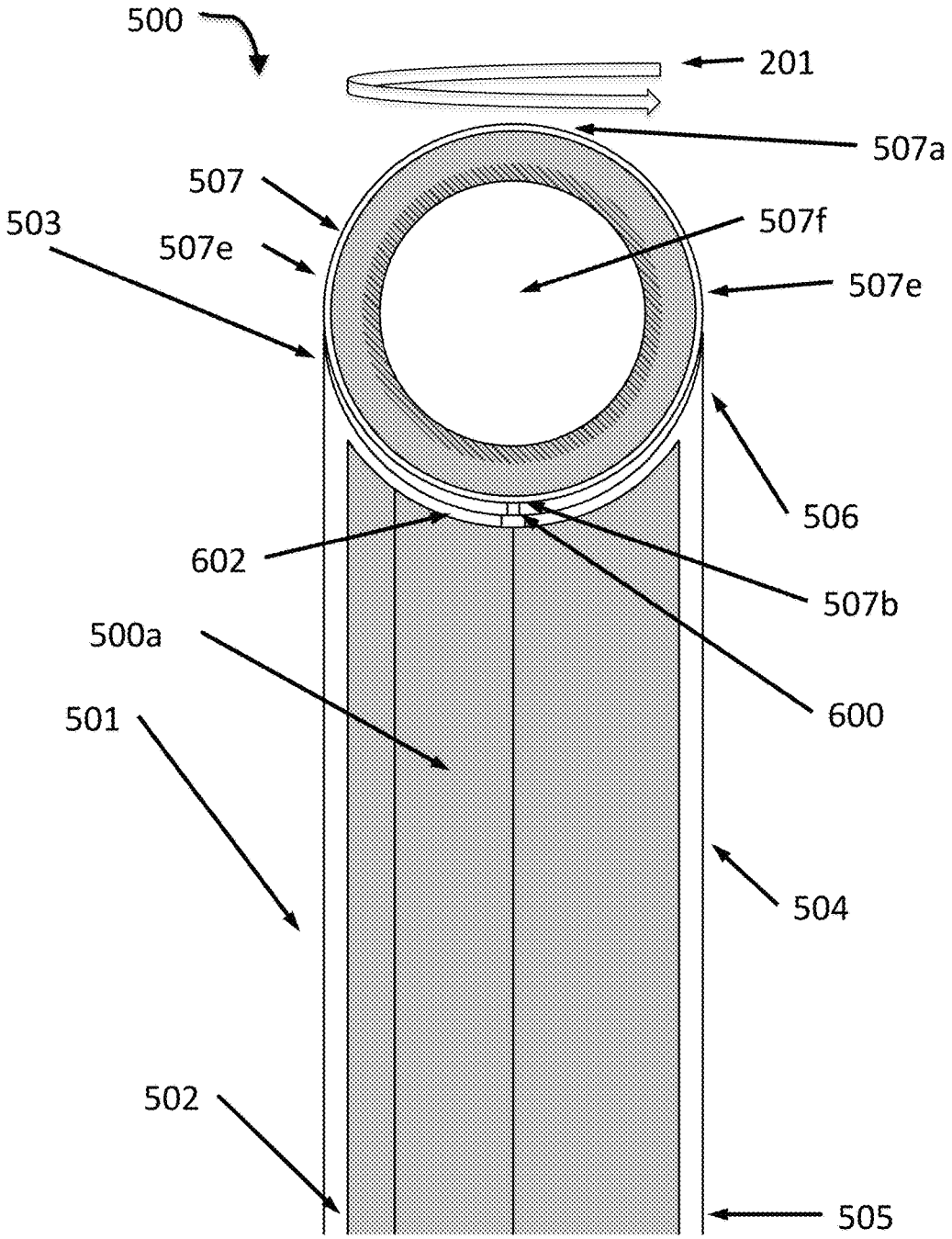
FIG. 5B is a schematic diagram illustrating one embodiment of an extension handle usable with an item of luggage.

FIGS. 5A-5B illustrate one embodiment of an extension handle 500 to be used with an item of luggage. Although FIGS. 5A-5B illustrate an embodiment of an extension handle with a piece of luggage, the disclosed embodiments may be used with any other item that would benefit from having an extension handle. Examples of such other items include, but are not limited to, items that have wheels and that are used for moving objects, such as carts (e.g., luggage carts), platforms, pallets, and hand trucks. The disclosed embodiments may also be used with items that do not have wheels, such as, for example, step-ladders. In the embodiment illustrated in FIGS. 5A-5B, the extension handle 500 includes a handle portion 500*a*, which includes at least one handle rod, a first handle rod 501, having a proximal end 502 and a distal end 503. When the extension handle 500 is in an extended position, the proximal end 502 of the first handle rod 501 is closer to the item of luggage than is the distal end 503. In some embodiments, the handle portion 500*a* includes a second handle rod 504 having a proximal end 505 and a distal end 506. In some embodiments, the extension handle 500 includes a grip 507 coupled to the distal end 503 of the first handle rod 501. It is to be understood that the word "coupled" means that the elements may be directly connected together, or they may be coupled through one or more intervening elements. In some embodiments, the grip 507 is directly connected to the distal end 503 of the first handle rod 501. It is to be understood that the word "coupled" means that the elements may be directly connected together, or they may be coupled through one or more intervening elements. In some embodiments, the extension handle 500 includes a grip 507 coupled to both the distal end 503 of the first handle rod 501 and the distal end 506 of the second handle rod 504. The extension handle 500 may be attached to an item of luggage 508. The extension handle 500 may include additional handle rods (not shown).

The first handle rod 501, and, if present, additional handle rods, such as the second handle rod 504, may be constructed from any material or combination of materials that render the at least one handle rod rigid and strong enough not to flex or break when used to haul a typical quantity of luggage or other item to which the extension handle 500 may be attached. The materials making up the at least one handle rod, including the first handle rod 501, and, if present, additional handle rods, such as the second handle rod 504, may include metal, synthetic polymers (e.g., plastic), natural polymers, wood, or any combination of these or other materials.

The at least one handle rod, including the first handle rod 501, and, if present, additional handle rods, such as the second handle rod 504, may be linear or curved, or it may have one or more portions that are linear and one or more portions that are curved. For example, the exemplary first handle rod 501 illustrated in FIGS. 5A-5B includes a linear portion between the proximal end 502 and the distal end 503. As described below, the distal end 503 may be attached to a bar 602, but alternatively the bar 602 can simply be a curved portion of the first handle rod 501 that extends from the distal end 503.

The at least one handle rod, including the first handle rod 501, and, if present, additional handle rods, may be solid or hollow; for instance, the at least one handle rod may be a tube. Where the at least one handle rod is hollow, the interior space of the at least one handle rod may be formed to accommodate a latch actuator 803 as described below in connection with FIGS. 8C-8E. The at least one handle rod may be a single, monolithic piece, or it may be constructed of multiple components connected together. In other embodiments, the at least one handle rod includes one or more mutually movable components (not shown). In some such embodiments, the one or more mutually movable components may be able to slide or pivot with respect to one another. For instance, the at least one handle rod may be incorporated in a telescoping handle, in which the at least one handle rod is slidably engaged in at least one chamber, where the at least one chamber is the interior of at least one additional handle rod (not shown). The at least one additional handle rod may be a stage in a telescoping handle; for instance, the at least one additional handle rod may slide into another hollow rod, or into a chamber in the luggage item or the item to which the extension handle 500 is attached. The at least one additional handle rod may be a plurality of nested telescoping sections. Persons skilled in the art will be aware that any number of such telescoping sections may be added to the at least one handle rod. The telescoping handle may include one or more latches (not shown) that can fix the one or more components relative to each other; for instance, where the handle is telescoping, the latches may fix each telescoping section with respect to the section in which it is inserted, so that when a given section is pulled out into an extended position, that section is fixed with respect to the section from which it is pulled out, making the telescoping handle substantially rigid until the latch is disengaged. The at least one handle rod may have any cross-sectional shape or combination of shapes, including polygons, circles, ellipses, and combined polygonal and curved shape; the cross-sectional shape may vary over the length of the at least one handle rod. Where the at least one handle rod includes a first handle rod 501 and a second handle rod 504, the second handle rod 504 may be constructed from any material or combination of materials suitable for making the first handle rod 501. The second handle rod 504 may have any form suitable for the construction of the first handle rod 501. In some embodiments, the first handle rod 501 is substantially identical to the second handle rod 504. In some embodiments, the second handle rod 504 is substantially a mirror image of the first handle rod 501.

Figure 6A:
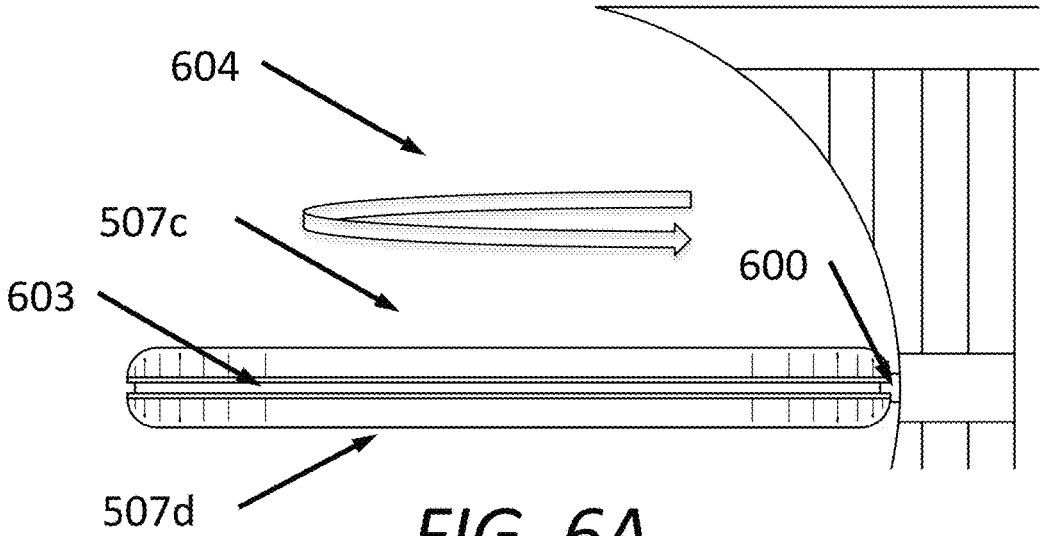
FIG. 6A is a schematic diagram illustrating one embodiment of an extension handle usable with an item of luggage.

In some embodiments, as shown in FIGS. 5B and 6A, the grip 507 is connected to the distal end 503 of the first handle rod 501 by a swivel 600 that allows the grip 507 to rotate freely about a first axis; for instance, the swivel 600 may allow the grip 507 to rotate about an axis parallel to the first handle rod 501, in the direction indicated by the arrow 201 in FIG. 5B, or in the opposite direction. In some embodiments having a first handle rod 501 and a second handle rod 504, the swivel 600 is attached to a bar 602 joining the two handle rods 501, 504; the swivel 600 may be fixed to a point on that bar 602 that is equidistant from both handle rods 501, 504.

In some embodiments, the swivel 600 is omitted, and the grip 507 is directly connected to the first handle rod 501. For example, the grip 507 may include a protrusion, such as a rod or a screw, that may be inserted through a hole (not shown) in the first handle rod 501 and joined to a cap or nut that prevents the grip 507 from disengaging from the first handle rod 501 when a user pulls on the grip 507. As another example, the grip 507 may include a grip-securing ridge (not shown) that allows the grip 507 to be rotatably mounted about a retaining lip (not shown) located on the end of the first handle rod 501. In some embodiments having a first handle rod 501 and a second handle rod 504 joined by a bar 602, the grip 507 can be directly connected to the bar 602 in similar ways. As would be appreciated by a person having ordinary skill in the art, there are many ways of directly attaching the grip 507 to the first handle rod 501 or to a bar 602 joining the first handle rod 501 to a second handle rod 504, and the examples provided herein are not intended to be limiting.

Figure 6B:
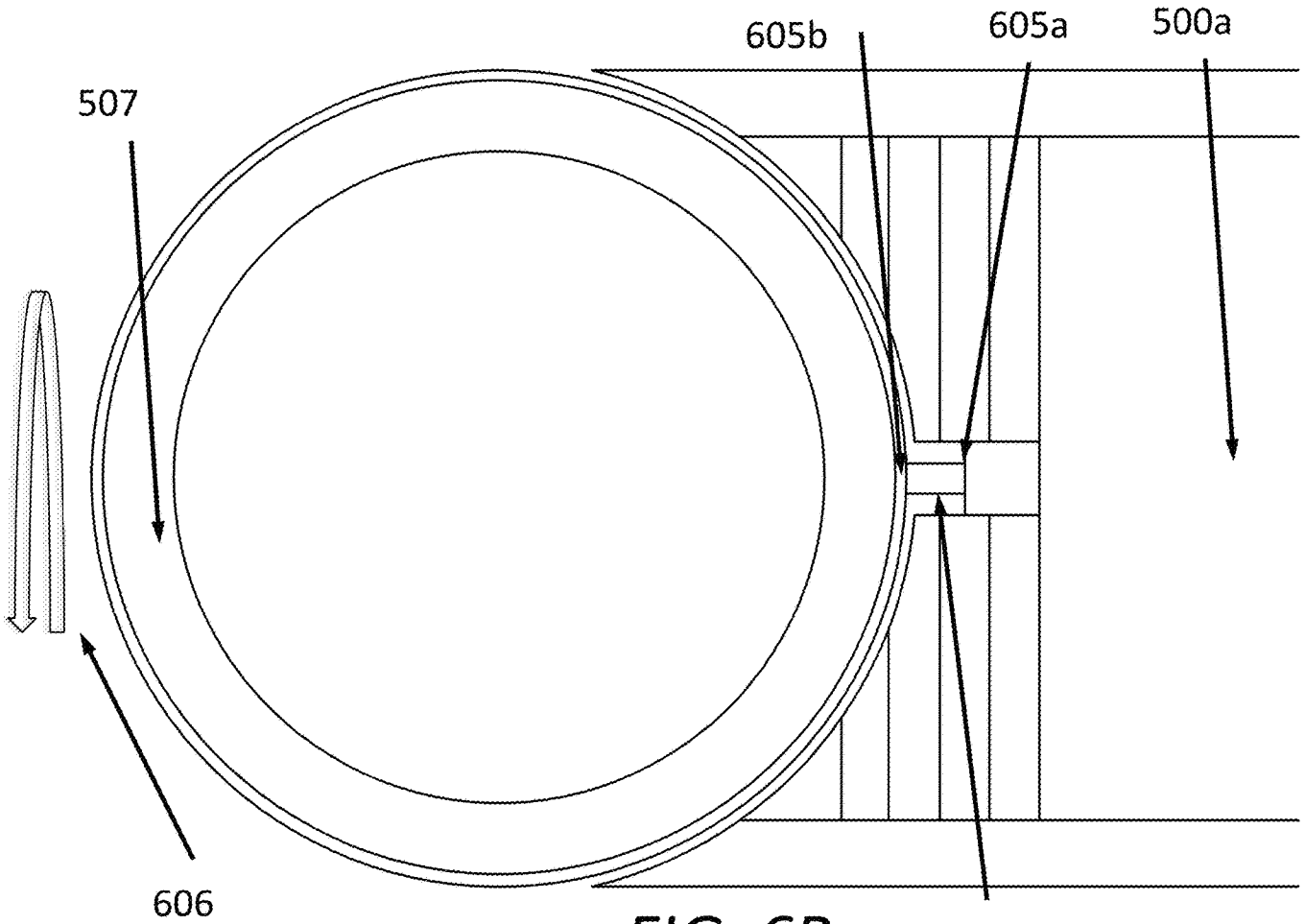
FIG. 6B is a schematic diagram illustrating one embodiment of an extension handle usable with an item of luggage.
Figure 6C:
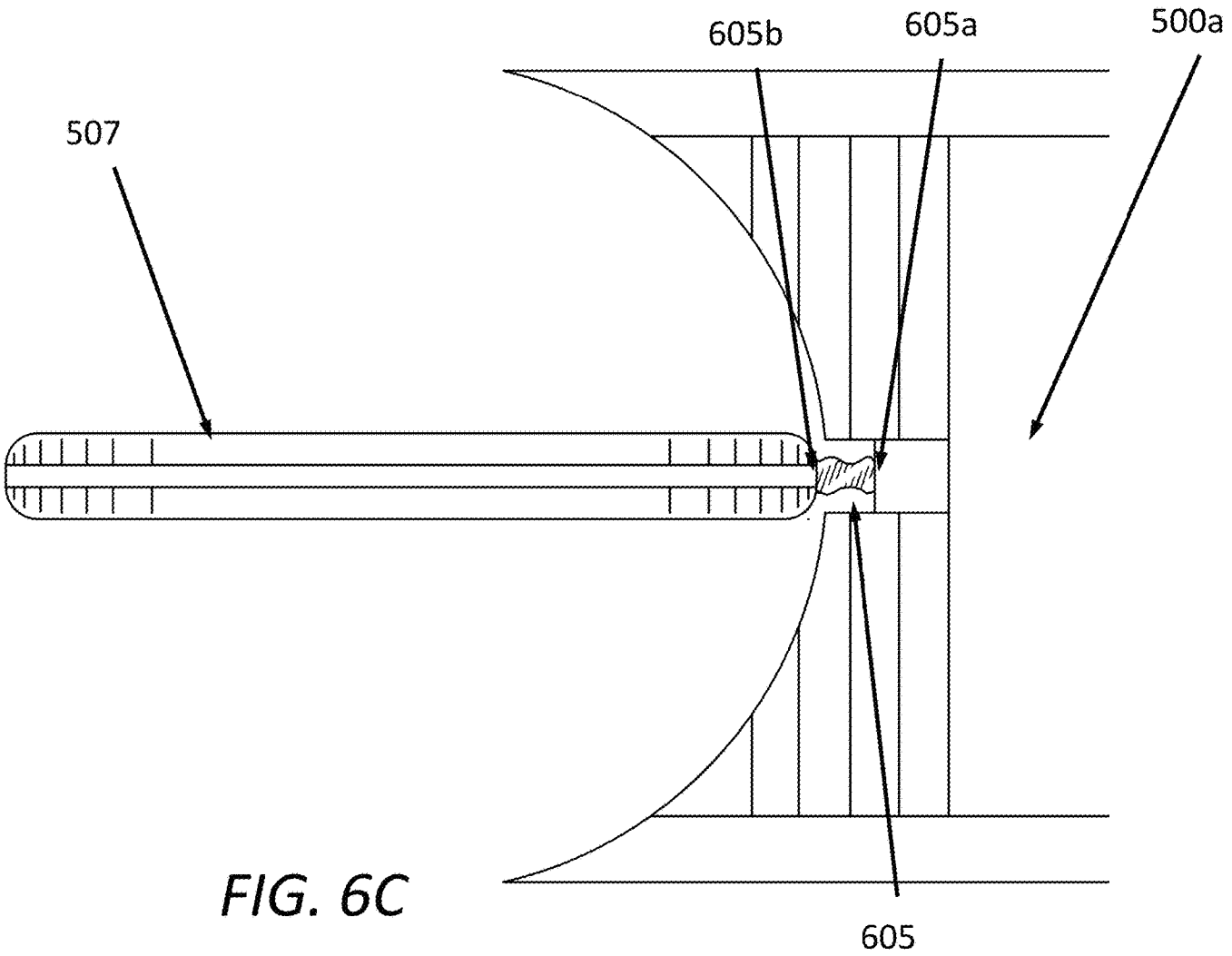
FIG. 6C is a schematic diagram illustrating one embodiment of an extension handle usable with an item of luggage.

In other embodiments, as shown in FIGS. 68 and 6C, the grip 507 is attached to the distal end of the at least one handle rod by a neck portion 605. The neck portion 605 may have a first end 605*a* affixed to the handle portion and a second end 605*b* affixed to the grip 507. In some embodiments, the neck portion 605 deforms elastically about a rotational axis intersecting the handle portion 500*a* and the grip 507 when the grip 507 is rotated relative to the handle portion 500*a* by a user. The axis may bisect the grip 507; rotation about the axis may occur in substantially the direction of rotation 606 shown in FIG. 6B, or in the opposite direction. The neck portion 605 may have a range of motion in two directions of rotation about the axis, such as the direction of rotation 606 and the opposite direction of rotation. In some embodiments, the neck portion 605 includes an elastic component that elastically deforms upon rotation; the elastic component may exert a recoil force tending to move the grip back to an elastically neutral position. The elastically neutral position may be a position in which the grip 507 is in substantially the same plane as the handle portion 500*a*. The elastic portion may be a spring, such as a coiled spring. The elastic portion may be a sleeve of elastic material, such as rubber. The elastic portion may be a strip of elastic material. The neck portion 605 may include a structural portion preventing the neck 605 from elongating or shearing. The structural portion may be a swivel joining the grip 507 to the handle portion 500*a*; as a non-limiting example, the swivel may have a first half fixed to the grip 507 and a second half fixed to the handle portion 500*a*, with the first half and second half connected together so that they rotate with respect to one another. The neck portion 605 may have a limited range of motion. The elastic portion may limit the range of motion; for instance, the recoil force of the elastic portion may be sufficiently strong at the limit of the range of motion to prevent further rotation impelled by a typical amount of force exerted by a user holding the grip. The elastic portion may reach the limits of its elastically deformable range and resist further deformation at the limit of the range of motion. In other embodiments, the neck portion 605 includes one or more structural elements that limit the range of rotation of the neck portion 605. For instance, at least one first structural element fixed to the grip 507 may engage at least one second structural element fixed to the handle portion 500*a* at each extreme of the range of motion. In some embodiments, the range of motion permits the grip 507 to rotate at most ninety degrees ($\pi/2$ radians) in either direction of rotation; in other words, the range of motion may permit the grip 507 to rotate a total of 180 degrees ($\pi$ radians), between a first point 90 degrees ($\pi/2$ radians) in one direction of rotation from the elastically neutral point, and a second point 90 degrees ($\pi/2$ radians) in the other direction of rotation from the elastically neutral point.

As illustrated in FIGS. 5B and 6, the grip 507 may have any shape conducive to being held easily in the hand of a user. In some embodiments, the grip 507 has a top 507*a*, a bottom 507*b* coupled to the at least one handle rod (e.g., the first handle rod 501 and, if present, the second handle rod 504 and any other additional handle rods), a front 507*c*, a back 507*d*, and two sides 507*e*. The grip 507 may take any shape conducive to use as a grip. Ire some embodiments, the grip 507 takes the for of a ring; in other words, the grip 507 has a transverse opening 507*f*, which is defined as an opening passing from the front 507*c* of the grip to the back 507*d* of the grip 507, so that a user's hand may be inserted through the transverse opening between the sides 507*e* of the grip 507 to take hold of the grip 507. For instance, where the grip 507 is a toroid, the transverse opening may be the hole through the toroid. Where the grip 507 is a ring, the grip 507 may take the form of any ring having a transverse opening as described above. The grip 507 may be, for example, a toroidal ring, a square ring, a triangular ring, or a D-ring. The exterior perimeter of a cross-section of the grip 507 taken halfway between the front and the back and parallel to the plane of the front may be a regular or irregular polygon. The exterior perimeter may contain one or more curved portions; for instance, the grip 507 may have the form of a polygon with rounded corners, or may have a semicircular portion combined with a linear or polygonal portion. Where the grip 507 has a transverse opening 507*f* through the grip 507, the cross-section may have an internal perimeter bordering the opening 507*f*. The internal perimeter may be any shape useable for the exterior perimeter; for instance, the cross-section may have a substantially square external perimeter, and a substantially square internal perimeter. The cross-section may have a substantially triangular external perimeter and a substantially triangular internal perimeter. The internal perimeter may be a different shape from the external perimeter.

Figure 5C:
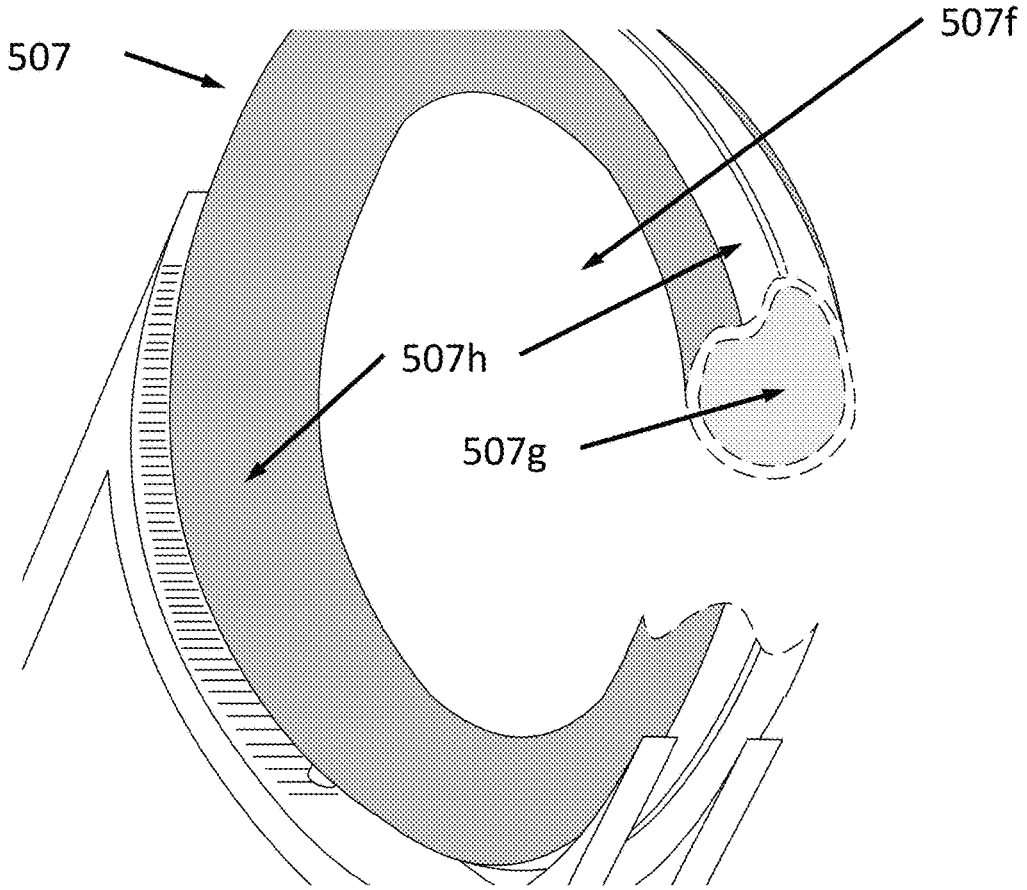
FIG. 5C is a schematic diagram illustrating on embodiment of an extension handle usable with an item of luggage.

In some embodiments, as illustrated in FIG. 5C, the grip 507 has an interior hollow portion 507*g*; for instance, where the grip 507 is a toroid, the grip 507 may be a tubular toroid similar to the inner tube of an automobile tire with an interior or lumen 507*g* that describes a toroid of air. In some embodiments, an object is inside the grip when it is within the interior hollow portion 507*g* of the grip 507, rather than in the hole 5071 through the grip. An object inside the grip 507 is thus enclosed by the outer surface of the grip 507, while objects in the hole 507*f* are outside of the grip. Thus, for instance, a motion transfer ring 808 as described below in reference to FIGS. 8C-8E is inside the grip 507 if the motion transfer ring 808 is within the interior hollow portion 507*g* of the grip. In other words, the grip 507 may have an exterior surface 507*h*, and the interior space 507*g* of the grip may be a space substantially all of which is enclosed by the exterior surface 507*h*; an object may be inside the grip if it is in a space substantially all of which is enclosed by the exterior surface 507*h*.

In some embodiments, the grip 507 is substantially toroidal. The substantially toroidal grip 507 may be circular or elliptical. In embodiments in which the grip 507 is substantially toroidal, the bar 602 may be in the form of an arc, allowing it to conform to the shape of the toroidal grip 507.

In some embodiments using a swivel 600 or neck portion 605, the grip 507 may have a track 603 on its exterior surface, in which the swivel 600 or neck portion 605 is slidably engaged; the swivel 600 or neck portion 605 may be slidably attached to the track 603, permitting the grip 507 to be rotated about a second axis, such as an axis orthogonal to the annular cross-section of the handle, about which the handle rotates in the direction indicated by the directional arrow 604 presented in FIG. 6. For instance, in some embodiments in which the grip 507 is substantially toroidal, the grip 507 contains a track 603 describing a substantial circle on the grip 507. In some embodiments, having one or two axes of rotation about which the grip 507 can freely rotate allows the user to hold the grip 507 more naturally, with an ergonomic wrist angle.

In some embodiments, as shown in FIGS. 7A-7F, where the at least one handle rod includes a first handle rod 501 and a second handle rod 504, the extension handle 500 includes at least one pocket 700 between the first handle rod 501 and the second handle rod 504. The at least one pocket 700 may have one or more flaps 701 that may be closed to secure the contents of the pocket 700 or opened to access the contents of the pocket 700. The one or more flaps 701 may be secured in their closed position by one or more fasteners (not shown), such as a hook-and-loop fastener, a zipper, a button, a snap, Velcro®, or any other type of fastener or combination of fasteners suitable to secure the contents of the pocket 700 when the one or more flaps 701 are closed.

In some embodiments, the extension handle 500 includes fold-out tray 702. The fold-out tray 702 may include at least one rigid panel, main panel 703 having a distal end 704, a proximal end 705, and a work surface 702*a*. In some embodiments, the fold-out tray 702 includes a connector 706 that enables the fold-out tray 702 to be slidably attached to the handle portion 500*a*. In other embodiments, the connector 706 is separate from the fold-out tray 702. The connector may be any connector that allows the fold-out tray 702 to be slidably attached to the handle portion 500*a*. Suitable connectors include, but are not limited to, hinges and ball joints. In some embodiments, the connector 706 attaches the proximal end 705 of the main panel 703 to the handle portion 500*a* (e.g., to the first handle rod 501 or, in embodiments having a first handle rod 501 and a second handle rod 504, to a rod or other rigid member (not shown) connected to one or both of the first handle rod 501 to a second handle rod 504). The connector 706 may permit the fold-out tray 702 to be rotated between a first position in which the work surface 702*a* of the fold-out tray 702 is substantially parallel to the first handle rod 501 and a second position in which the work surface 702*a* of the fold-out tray 702 is substantially perpendicular to the first handle rod 501, with the distal end 704 projecting away from the first handle rod 501.

Figure 7A:
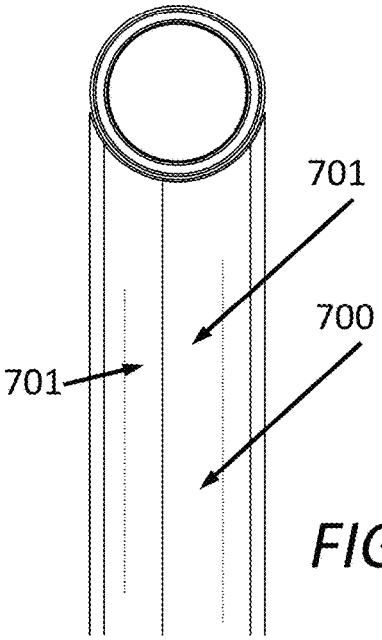
FIG. 7A is a schematic diagram illustrating one embodiment of an extension handle with a pocket.
Figure 7B:
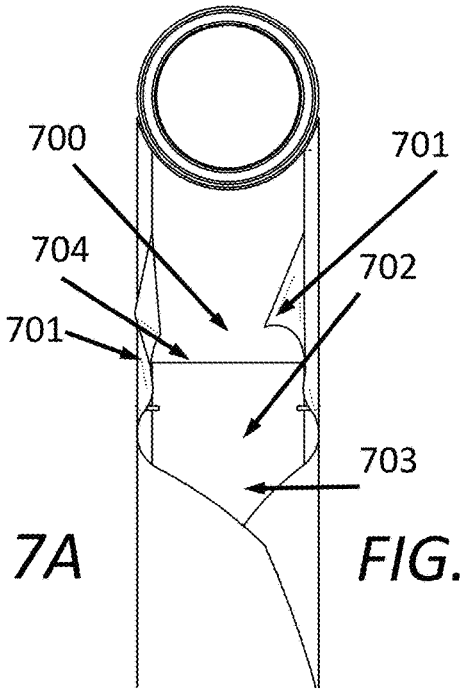
FIG. 7B is a schematic diagram illustrating one embodiment of an extension handle with a fold-out tray.
Figure 7C:
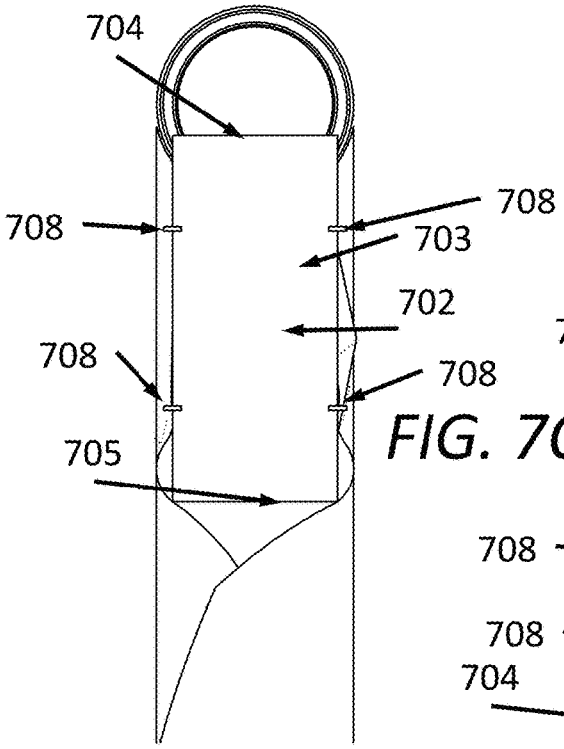
FIG. 7C is a schematic diagram illustrating one embodiment of an extension handle with a fold-out tray.
Figure 7D:
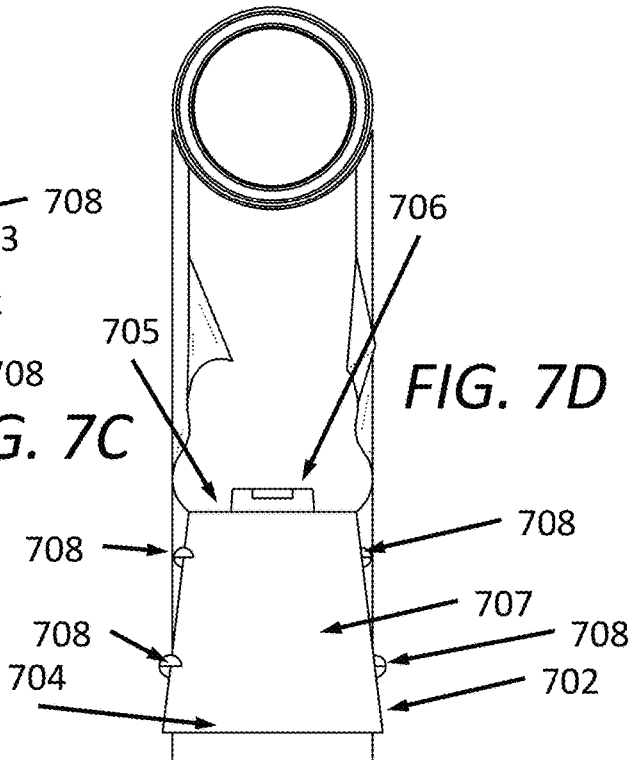
FIG. 7D is a schematic diagram illustrating one embodiment of an extension handle with a fold-out tray.
Figure 7E:
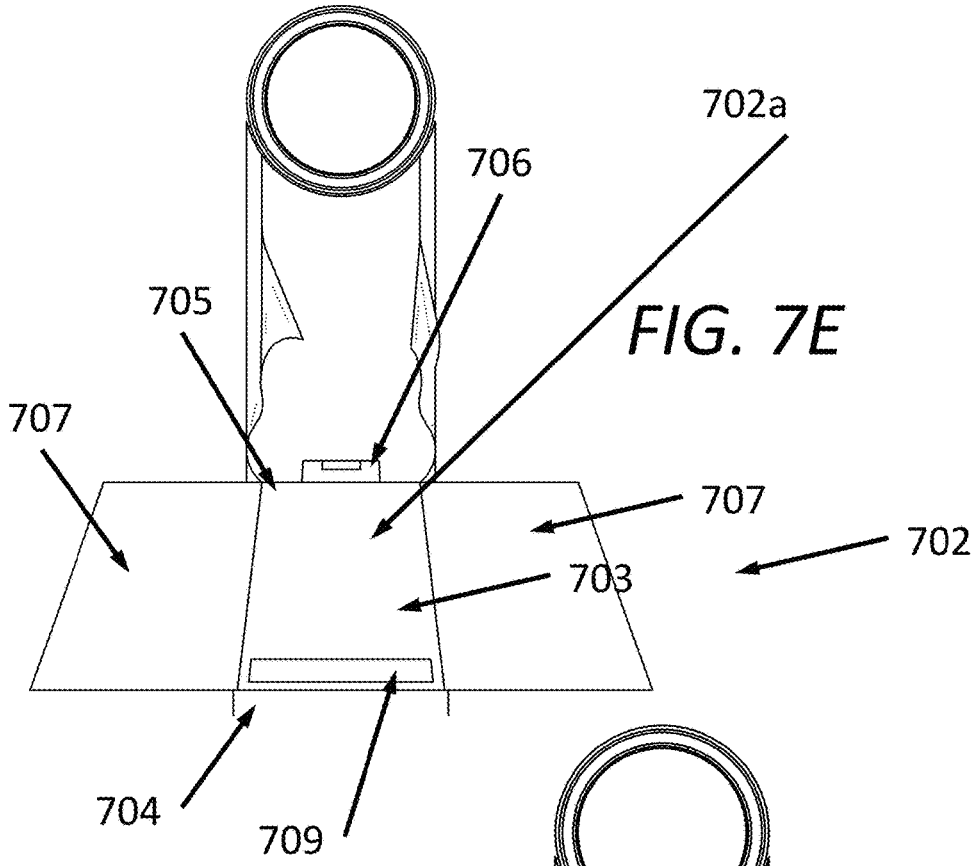
FIG. 7E is a schematic diagram illustrating one embodiment of an extension handle with a fold-out tray.
Figure 7F:
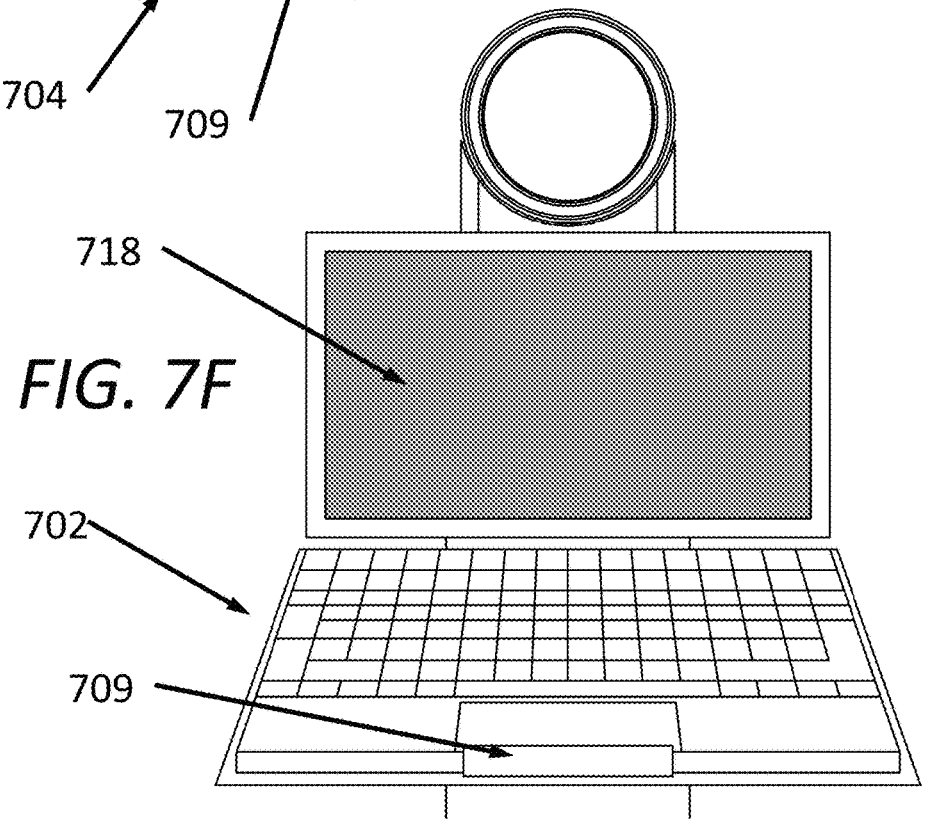
FIG. 7F is a schematic diagram illustrating one embodiment of an extension handle with a fold-out tray.
Figure 7G:
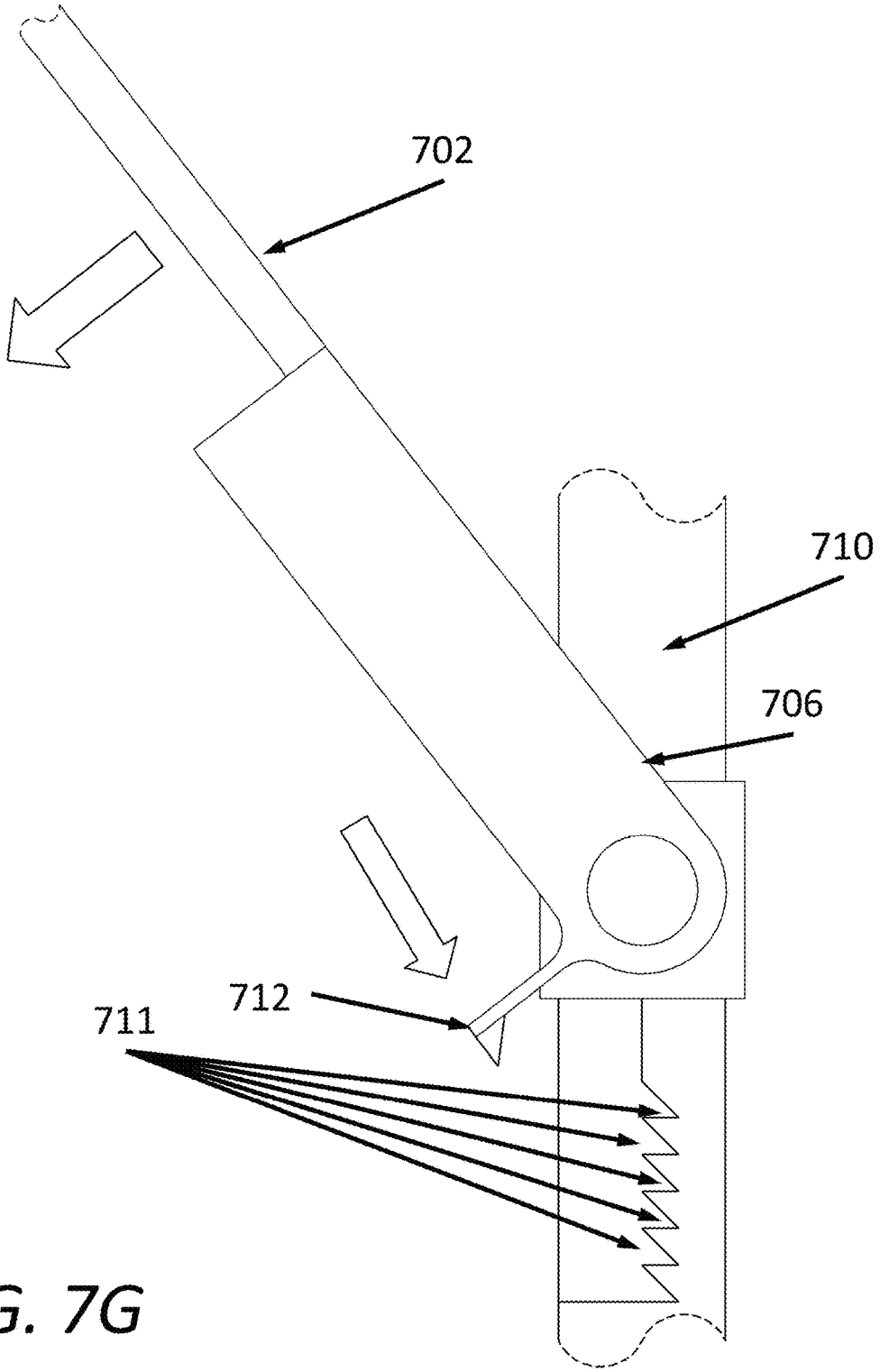
FIG. 7G is a schematic diagram illustrating one embodiment of an extension handle with a fold-out tray.
Figure 7H:
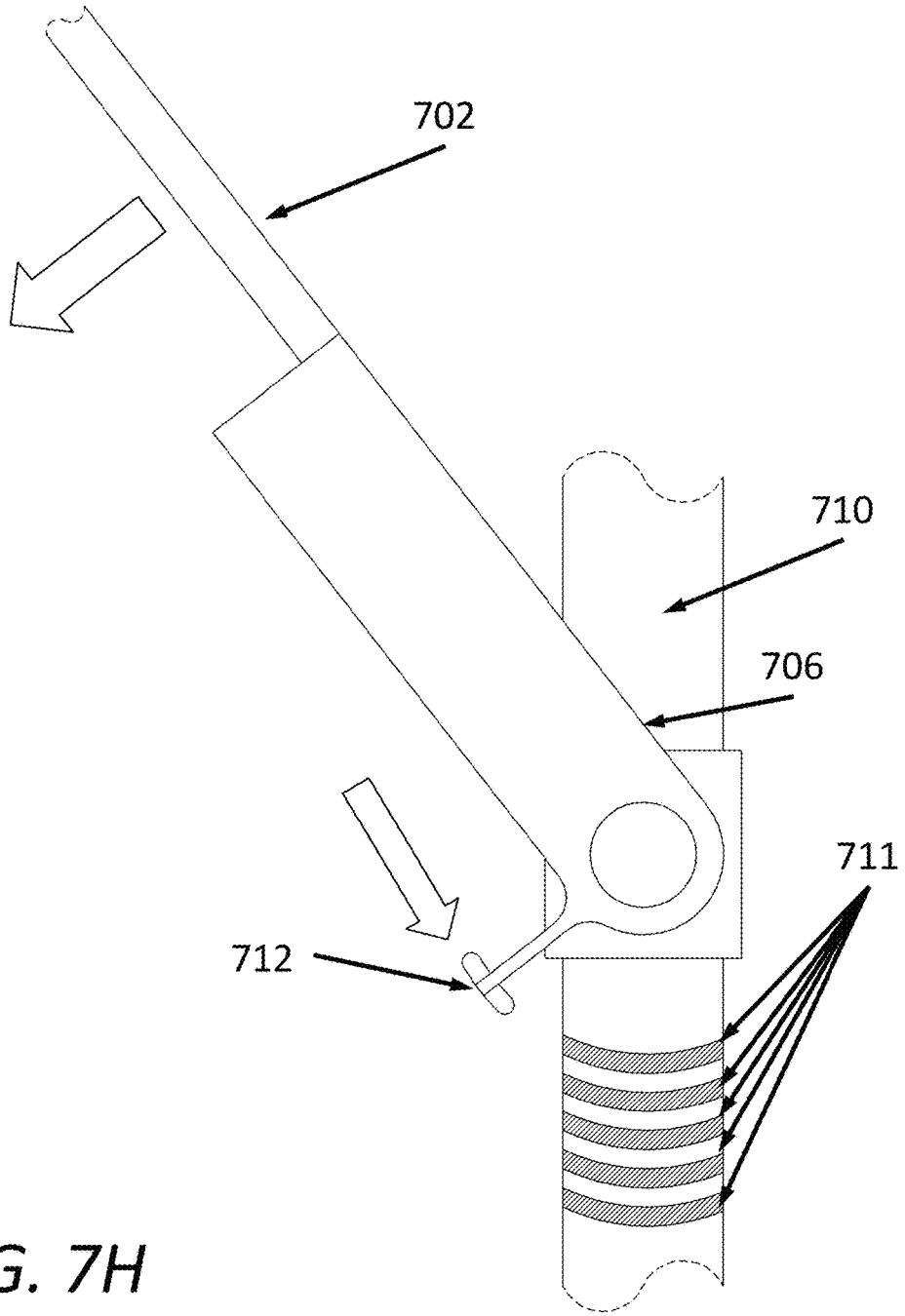
FIG. 7H is a schematic diagram illustrating one embodiment of an extension handle with a fold-out tray.

In some embodiments, such as the exemplary embodiment illustrated in FIGS. 7G and 7H, the connector 706 is attached to at least one mounting rod 710 of the handle portion 500*a*. Where the at least one handle rod includes a first handle rod 501 and a second handle rod 504, the at least one mounting rod 710 may be set between the first handle rod 501 and the second handle rod 504. Alternatively, the at least one mounting rod 710 may be entirely separate from the first and second handle rods 501 and 504. In some embodiments, the at least one mounting rod 710 is coupled to the first and second handle rods 501 and 504. In other embodiments, the at least one mounting rod 710 is coupled to an item of luggage but not to the first or second handle rods 501, 504. The at least one mounting rod 710 may be oriented horizontally, vertically, or in any other orientation convenient for attaching the fold-out tray 702. The at least one mounting rod 710 may be the at least one handle rod; for instance, the at least one rod may be the first handle rod 501, the second handle rod 504, or both the first and second handle rods 501 and 504, as described above in reference to FIGS. 5A-5B. The connector 706 may be slidably mounted on the at least one mounting rod 710; for instance, a hole through a part of the connector 706 may fit snugly but slidably on the at least one mounting rod 710. In some embodiments, the connector 706 is mounted on the at least one mounting rod 710 using a sleeve fixed to the connector 706, the sleeve fitting snugly around the at least one mounting rod 710. In some embodiments, the weight of the fold-out tray 702 itself, or the weight of an item placed on the fold-out tray 702 in combination with the weight of the fold-out tray 702 itself, fixes the position of the connector 706 with respect to the at least one mounting rod 710 through static friction. In some embodiments, the connector 706 has a latch (not shown) causing the connector 706 to remain in a fixed position along the length of the at least one mounting rod 710; the latch may be any suitable latch to engage a connector to a rod. In some embodiments, the latch may be a spring-loaded bolt or pin mounted in the connector 706 that engages a hole or slot in the at least one mounting rod 710, and which the user must push or pull out of the hole or slot to enable the connector 706 to slide again; the connector 706 may have an object on its outer surface that the user may push or pull to disengage the bolt or pin. In other embodiments, the at least one mounting rod 710 has an obstruction, such as a flange, that arrests the connector's movement when it has been slid to the proper height for deploying the fold-out tray 702. The latch may engage automatically and disengage automatically given sufficient force by the user, as described below for a latch fixing the first handle rod 501 in reference to FIGS. 8A-8E. The connector 706 may similarly be attached to the at least one handle rod 501, first handle rod 501, the second handle rod 504, or to both handle rods; the connector 706 may be fixed to each or both of the handle rods, or slidably attached to each or both of the handle rods.

In some embodiments, the position of the at least one rod may be adjusted. In some such embodiments, the connector 706 is affixed (e.g., permanently affixed) to the at least one mounting rod 710, and the position of the at least one mounting rod 710 can be adjusted to adjust the height of the fold-out tray 702 when it is deployed (i.e., when the work surface 702*a* of the fold-out tray is substantially perpendicular to the first handle rod 701). For example, in some embodiments, the at least one mounting rod 710 is oriented substantially horizontally (i.e., perpendicular to the first handle rod 501 and the second handle rod 504) within the extension handle 500*a*, with a first end coupled to the first handle rod 501 and a second end coupled to the second handle rod 504, and the positions of the first and second ends of the mounting rod 710 are adjustable along the lengths of the first handle rod 501 and the second handle rod 504. It is to be understood that a plate or other component suitable for attachment to the fold-out tray 702 may be included in the extension handle 500*a* in lieu of the described at least one mounting rod 710.

In some embodiments, the rotation of the fold-out tray 702 into its deployed position causes the position of the fold-out tray 702 to become fixed with respect to the at least one mounting rod 710 on which the connector 706 is slidably engaged. In some embodiments, the at least one mounting rod 710 has at least one support feature 711 including an upward-facing surface. The upward-facing surface of the at least one support feature 711 may be a surface substantially perpendicular to the direction in which the connector 706 travels on the at least one mounting rod 710; the upward-facing surface may be curved or slanted, as well. The at least one support feature 711 may be one or more notches, as depicted in FIG. 7G, with the upward facing surface forming a floor of each notch; the one or more notches may be a plurality of notches arranged in a saw-tooth pattern. The at least one support feature 711 may be one or more grooves, as illustrated in FIG. 7H; the grooves may be substantially horizontal in orientation, such that an object traveling down one of the grooves will travel in a mostly horizontal direction. Each groove may be shaped to admit a member that rotates into the groove upon the rotation of the fold-out tray 702 about the connector; for instance, each groove may be substantially arcuate. The fold-out tray 702 may include a member 712 that engages the at least one support feature 711 when the fold-out tray 702 is rotated about its connector 706 into deployed position; when the member 712 engages the at least one support feature 711, the fold-out tray may become fixed with respect to the at least one mounting rod 710. For example, the member 712 may be a protrusion that rests on the upward-facing surface when the pullout tray 702 is rotated into its deployed position. As a non-limiting example, as shown in FIGS. 7G and 7H, the member 712 may be included in or attached to the connector 706 so that when the fold-out tray 702 is rotated into the deployed position, the member 712 engages the at least one support feature 711. The member 712 may be constructed of any materials or combination of materials suitable for the construction of the at least one handle rod 501. In some embodiments, when the member 712 is engaged with the at least one support feature 711, by resting on the upward-facing surface, the connector 706 cannot slide with respect to the at least one mounting rod 710; as a result, while the fold-out tray 702 is deployed, it will not slide with respect to the at least one mounting rod 710. In some embodiments, where the at least one support feature 711 is a plurality of notches arranged in a saw-tooth array, the member 712 and notches may be formed so that, if the fold-out tray 702 is in its deployed position, the user can move the connector 706 upward along the at least one mounting rod 710, and the member 712 will travel up the plurality of notches, consecutively engaging each notch so that the fold-out tray 702 cannot travel down the at least one mounting rod 710 without being rotated out of the deployed position e.g., by the user lifting the distal end 704 of the main panel 703 to disengage the member from the notches and then sliding the fold-out tray 702 down the at least one mounting rod 710).

The connector 706 may be constructed to have a range of motion substantially limited to 90 degrees; as a result, the fold-out tray 702 may be held in its extended, horizontal (i.e., deployed) position by the lower limit of the range of motion of the connector 706. In other embodiments, the fold-out tray 702 has a brace or reinforcing rod (not shown) that further limits its downward motion and helps to support the weight of objects set on the tray.

In some embodiments, when the extension handle 500 includes a pocket 700, the fold-out tray 702 may stow in the pocket when rotated into the position substantially parallel to the at least one handle rod. The stowing process may involve rotating or sliding the fold-out tray 702 down to stow it completely within the pocket 700, and securing it in place by closing the pocket 700. In some embodiments in which the fold-out tray 702 does not stow within a pocket 700, the fold-out tray 702 may be maintained in its position substantially parallel to the at least one handle rod by a latch or strap, by one or more magnets, or by friction. For instance, in embodiments including the first handle rod 501 and the second handle rod 704, the fold-out tray 702 may be sized to fit snugly between the first 501 and second 504 handle rods. In some embodiments, the fold-out tray 702 is detachable from the handle portion 500*a*. For instance, a portion of the connector 706 that is slidably engaged with the at least one mounting rod 710 may be removable from the at least one mounting rod 710. In some embodiments, the fold-out tray 702 is detachable from the connector 706, and the connector 706 may or may not be detachable from the at least one mounting rod 710.

Referring now to FIGS. 7C-7E, in some embodiments, the fold-out tray 702 has one or more leaves 707, each of which has a work surface. In some embodiments, the one or more leaves 707 are joined to the main panel 703 by at least one connector 708 that permits the leaves 707 to be deployed from a folded position resting on the main panel 703 to deployed position adjacent to the main panel 703 so that the work surface of each of the one or more leaves 707 acts as an extension to the work surface 702*a* of the main panel 703. In some embodiments, where there are two leaves 707 a first leaf may have a connector 708 having a larger offset than the connector 708 of a second leaf, so that the first leaf can rest on top of the second leaf when the second leaf and first leaf are in the folded positions. The one or more leaves 707 may be rigid, as defined above in reference to FIGS. 1A-1E. The at least one connector 708 may support the one or more leaves 707 in their deployed positions. In some embodiments, the fold-out tray 702 includes a lip 709 at the distal end 704 of the main panel 703. The lip 709 may fold against the main panel 703, for instance, using a connector (not shown), and may deploy to a substantially vertical position to help secure an object 718 placed on the fold-out tray 702.

Figure 7I:
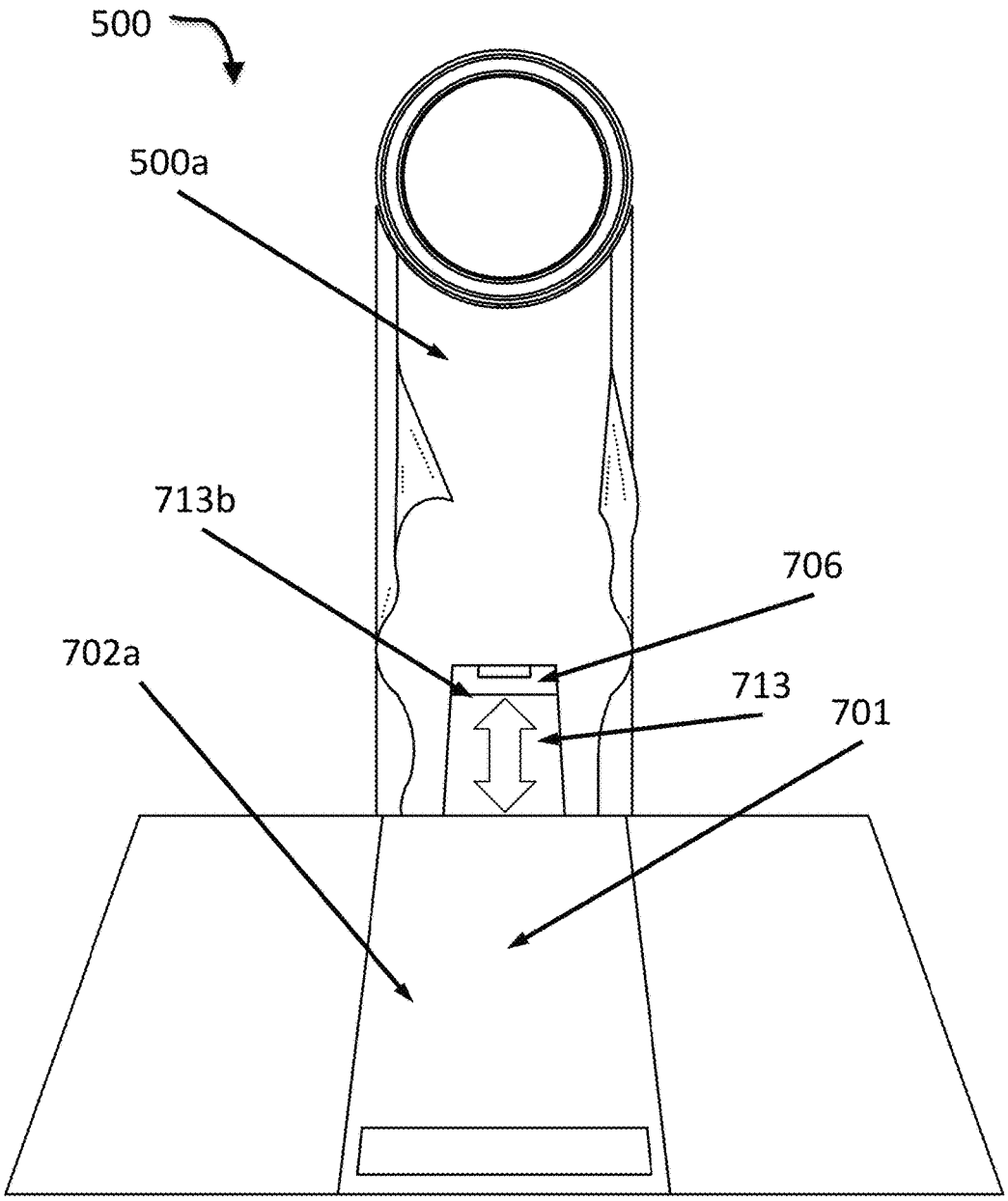
FIG. 7I is a schematic diagram illustrating one embodiment of an extension handle with a fold-out tray, showing a perspective view of the top side of the tray with a slide member.
Figure 7J:
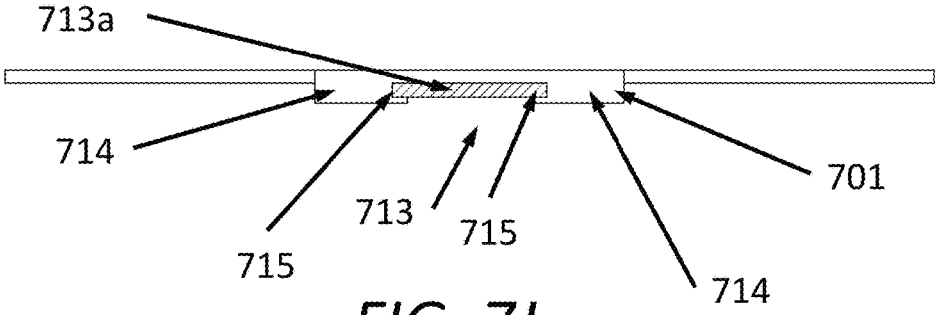
FIG. 7J is a schematic diagram illustrating one embodiment of an extension handle with a fold-out tray, as seen from the front edge of the tray.
Figure 7K:
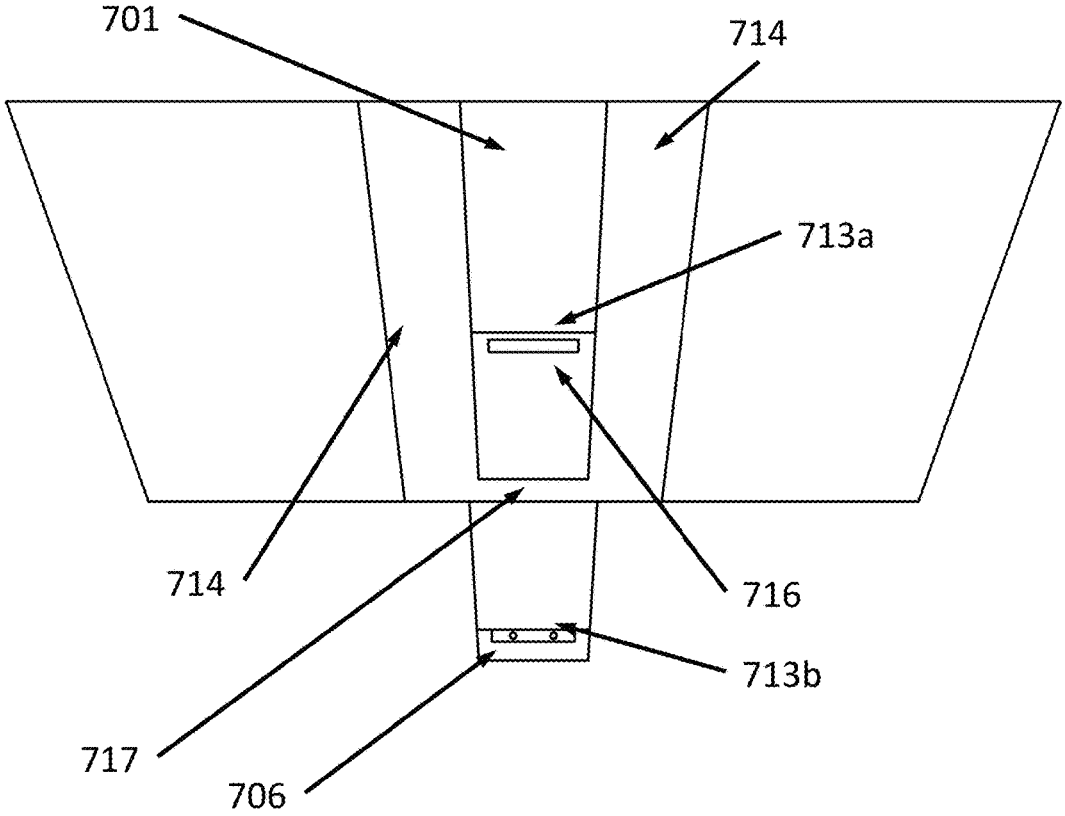
FIG. 7K is a schematic diagram illustrating one embodiment of an extension handle with a fold-out tray, with a view of the underside of the tray and a slide member.

Some embodiments include features to make the tray extendible. In some embodiments, as illustrated in FIGS. 7I-7K, the extension handle 500 includes a slide member 713 fixed to the connector 706. The connector 706 may be attached to the proximal end 705 of the main panel 703 by slidably engaging the main panel 703 with the slide member 713. The slide member 713 may have a distal end 713*a* (shown in FIGS. 7J and 7K) and a proximal end 713*b* coupled to the connector 706. In some embodiments, the slide member 713 is a panel. The slide member 713 may be inserted in the main panel 703. The slide member 713 may be placed in contact with the underside of the main panel 703. For instance, as illustrated in FIGS. 7J-7K, the main panel 703 may have one or more downward projections 714 having grooves 715 that slidably engage the slide member 713; as a non-limiting example, there may be two downward projections 714 having grooves 715 that face each other and are spaced to slidably admit two opposite edges of a panel-shaped slide member 713, holding the slide member 713 against the underside of the main panel 703 and constraining the main panel 703 to slide along only one axis. The slide member 713 may additionally include a stopper 716 that prevents the main panel 703 from detaching from the slide member 713. The main panel 703 may have a stopper contacting member 717 that contacts the stopper 716 to prevent the main panel 703 from detaching from the slide member 713; as a non-limiting example, the stopper 716 may be located at the distal end 713*a* of the slide member 713, and the stopper contacting member 717 may be located at the proximal end 705 of the main panel 703. The stopper 716 may be on the underside 713*c* of the slide member 713. The stopper-contacting member 717 may be attached to the underside of the main panel 703. In some embodiments, the slide member 713 enables the length of the fold-out tray 702 to be extended by sliding the main panel 703 away from the connector 706 on the slide member 713.

As illustrated in FIG. 5A, the extension handle 500 may be attached to an item of luggage 508. The item of luggage 508 may be a receptacle used to transport articles during travel. For example, the luggage 508 may be a suitcase, a wheeled suitcase, an attaché case, a duffel bag, a backpack, a bag (e.g., a canvas or laundry bag), a briefcase, an item of wheeled luggage, or any other receptacle or platform for moving items about. Any material or combination or materials used to make an item of luggage may be used to make the item of luggage 508, including natural and synthetic textiles, any rigid materials such as metals, rigid polymers such as plastic, wood, ceramic, fiberglass, or other rigid composite materials, and any flexible or semi-flexible sheets of natural or synthetic polymers. In some embodiments, the luggage item 508 is a collapsible suitcase 100 as described above in reference to FIGS. 1A-4D. As another example, the suitcase 100 may incorporate the extensible handle system 500, and be wholly or partially collapsible or extensible using a different structure than the collapsible structure described above in reference to FIGS. 1A-4D.

In some embodiments, the extension handle 500 is retractable. Where the at least one handle rod is part of a set of mutually sliding components as described above in reference to FIGS. 5A-5B, the extension handle 500 may be retractable by sliding the components relative to each other so that the at least one handle rod reduces in length. For instance, where the first handle rod 501 and second handle rod 504 are made of telescoping sections, the extension handle 500 may be retracted by sliding the telescoping sections so that they nest within one another. In some embodiments, the extension handle 500 is retracted by sliding the handle with respect to the luggage 508; for instance, the at least one handle rod may each be slidably engaged on a track on the outside of the luggage 508. In some embodiments, the extension handle 500 is slidably engaged inside of the luggage 508, for example, in a chamber of the luggage 508. The at least one handle rod 501 may be slidably engaged (e.g., on a track) in at least one chamber of the luggage 508, so that a user can slide the at least one handle rod between a retracted position in which substantially all of the at least one handle rod is within the at least one chamber, and an extended position in which substantially all of the at least one handle rod except for the distal end of the at least one handle rod is outside of the at least one chamber. The at least one chamber may be incorporated in the luggage 508. For example, the at least one chamber may be formed within the luggage 508. The at least one chamber may be separately formed and attached to the luggage 508 using fasteners or other means. In some embodiments, the extension handle 500 is slidably engaged in a single chamber as described in further detail below in connection with FIGS. 9A-9D.

Figure 8A:
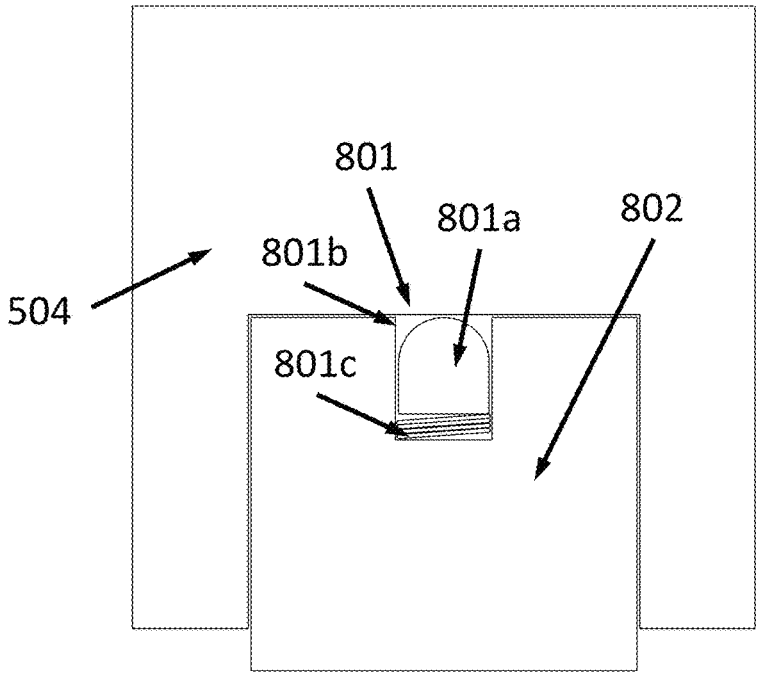
FIG. 8A is a schematic diagram illustrating one embodiment of an extension handle with an engagement latch.
Figure 8B:
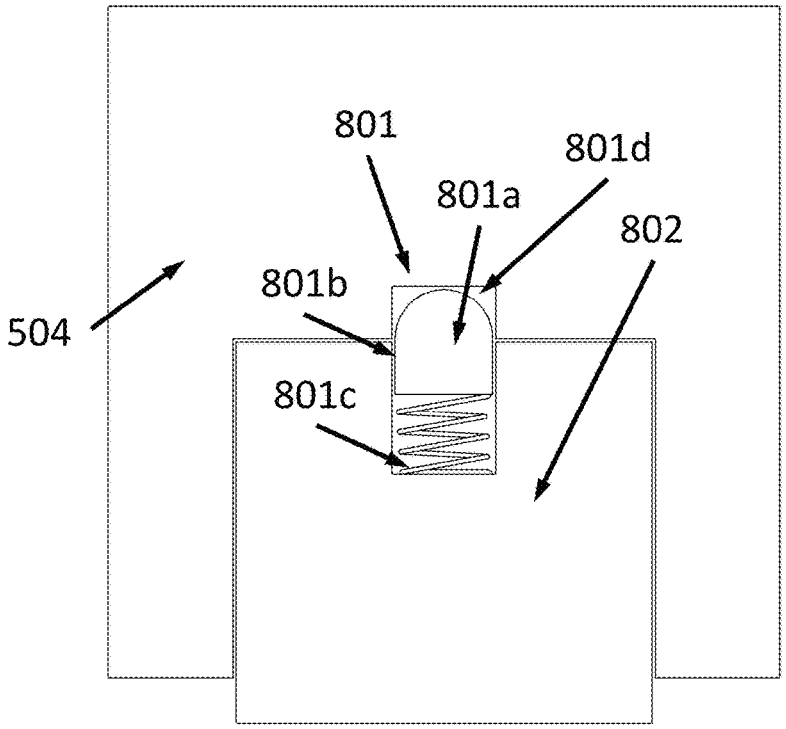
FIG. 8B is a schematic diagram illustrating one embodiment of an extension handle with an engagement latch.
Figure 8C:
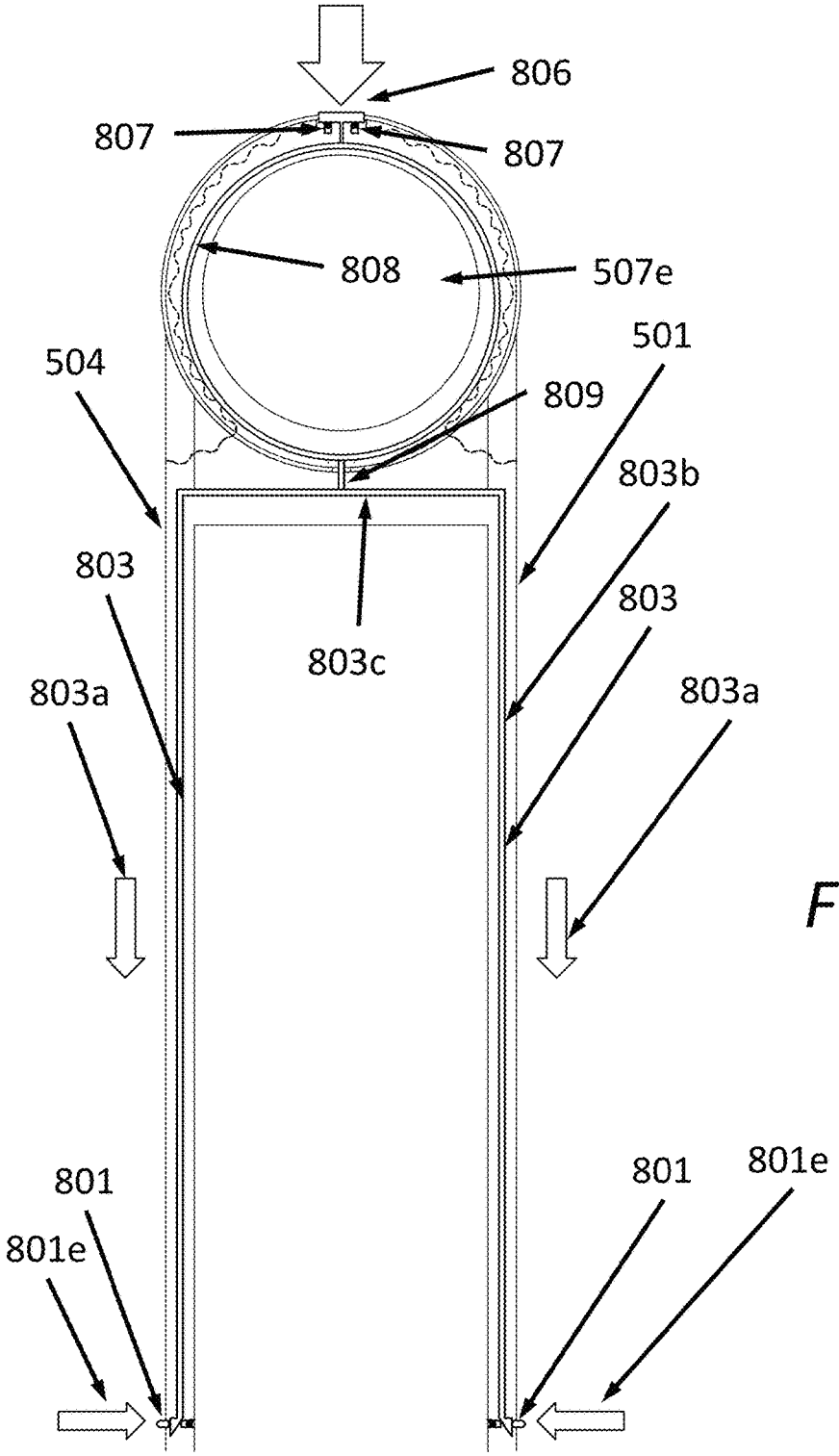
FIG. 8C is a schematic diagram illustrating one embodiment of an extension handle with an engagement latch.
Figure 8D:
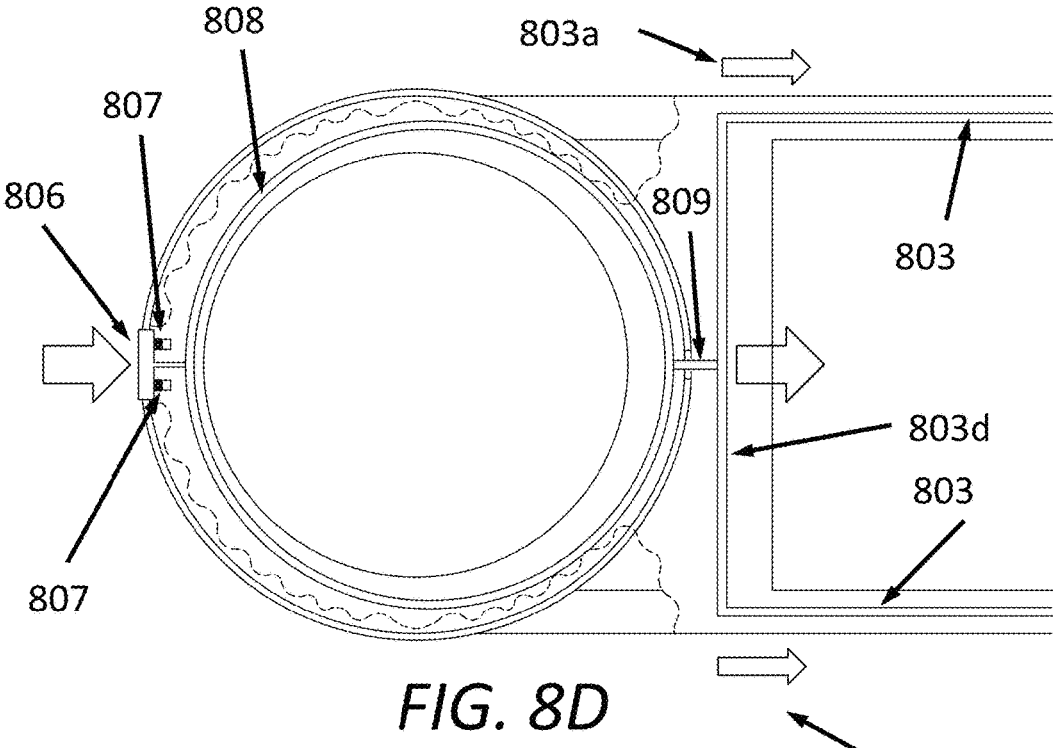
FIG. 8D is a schematic diagram illustrating one embodiment of an extension handle with an engagement latch.
Figure 8E:
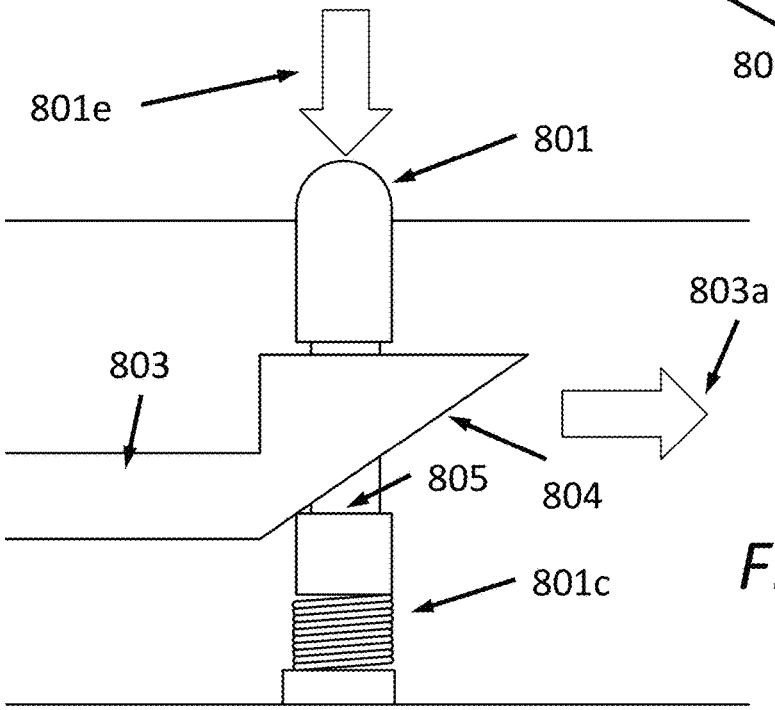
FIG. 8E is a schematic diagram illustrating one embodiment of an extension handle with an engagement latch.
Figure 9A:
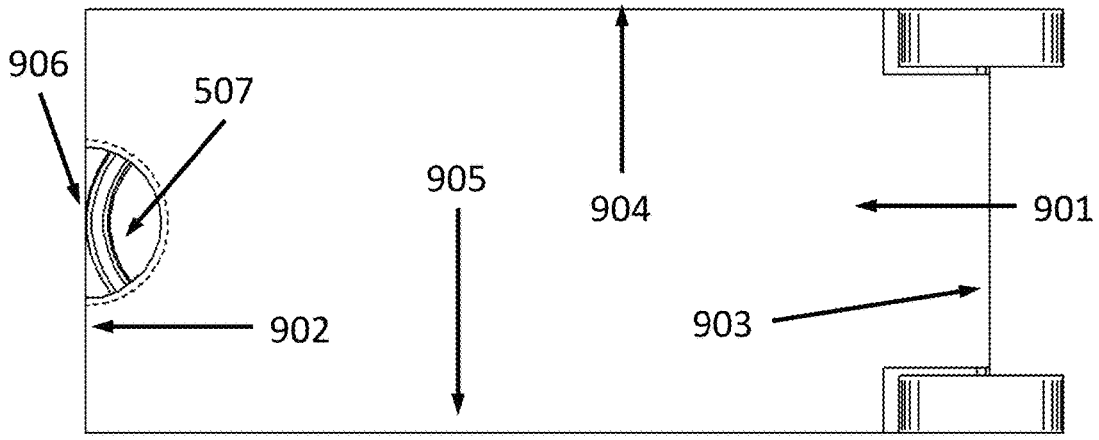
FIG. 9A is a schematic diagram illustrating one embodiment of an extension handle incorporated in a chamber.
Figure 9B:
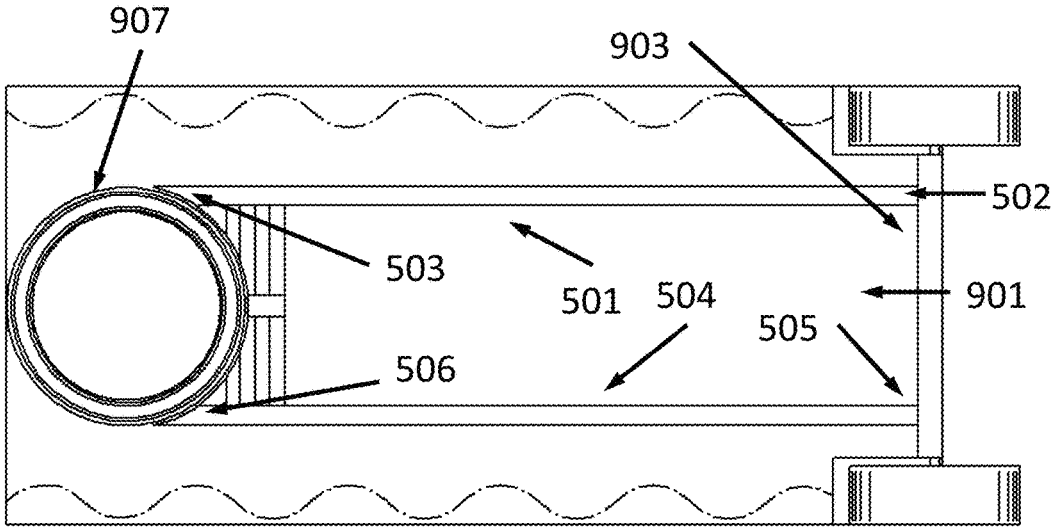
FIG. 9B is a schematic diagram illustrating one embodiment of an extension handle incorporated in a chamber.
Figure 9C:
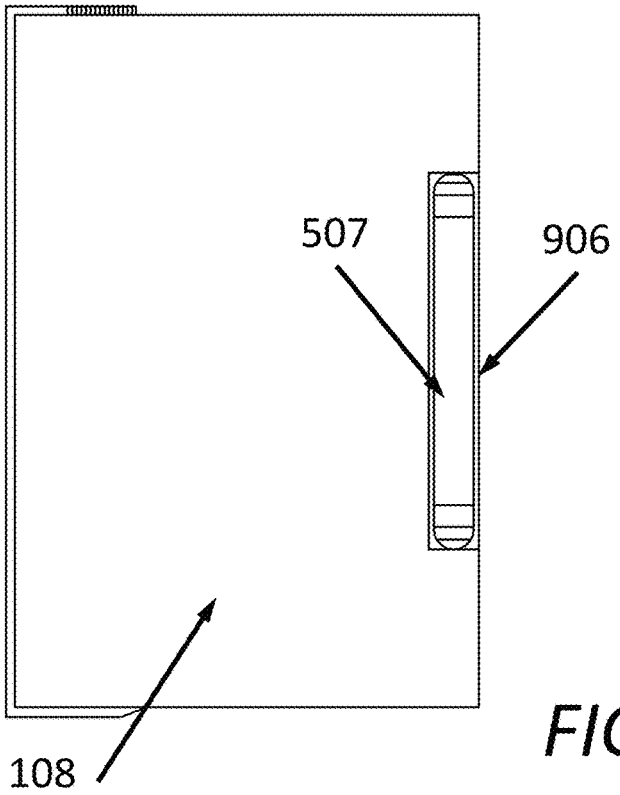
FIG. 9C is a schematic diagram illustrating one embodiment of an extension handle incorporated in a chamber.
Figure 9D:
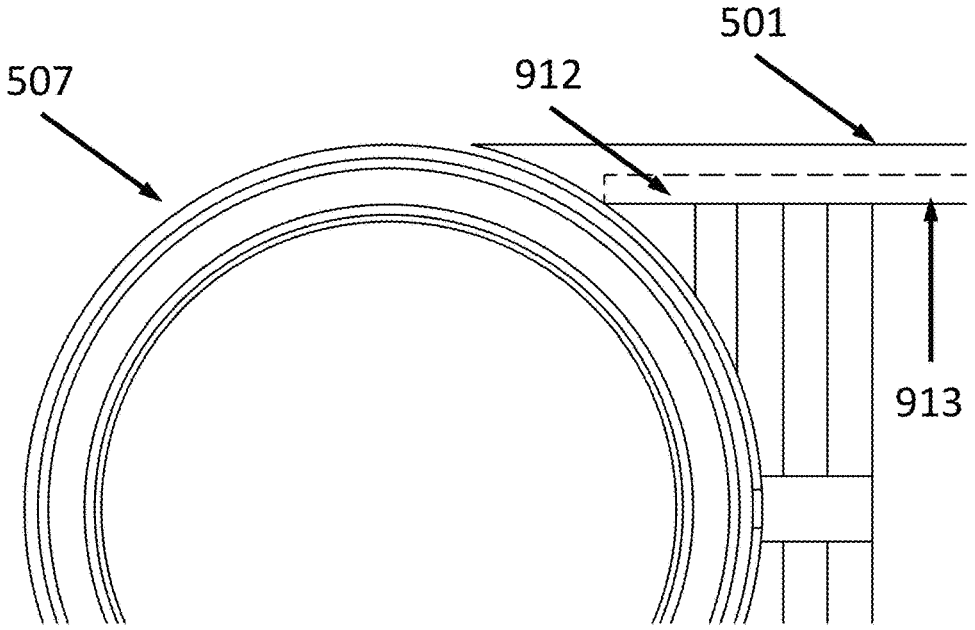
FIG. 9D is a schematic diagram illustrating one embodiment of an extension handle incorporated in a chamber.

Referring now to FIGS. 8A-8E, in embodiments iii which the extension handle is retractable by slidable engagement with the luggage 508, at least one engagement latch may fix the at least one handle rod in its extended position. For instance, the at least one engagement latch may include a first engagement latch 801 that fixes the proximal end 502 of the first handle rod 501 relative to the luggage 508 when the first handle rod 501 is in the extended position. Where the at least one handle rod includes a first handle rod 501 and a second handle rod 504, the at least one engagement latch may include a first engagement latch 801 that fixes the proximal end 502 of the first handle rod 501 relative to the luggage 508 when the first handle rod 501 is in the extended position and a second engagement latch 801 (not shown) that fixes the proximal end 505 of the second handle rod 504 relative to the luggage 508 when the second handle rod 504 is in the extended position. As illustrated in FIGS. 8A-8B, the engagement latch 801 may include a pin 801*a* in a chamber 801*b* in the first handle rod 501, or in a surface past which the first handle rod 501 slides, which is urged out of its chamber 801*b* by a spring 801*c* or similar biasing means, so that when a corresponding chamber 801*d* in a structure 802 past which the first handle rod 501 slides moves opposite the chamber 801*b* containing the pin 801*a*, the pin 801*a* will enter the corresponding chamber 801*d*. The pin 801*a* may be rounded at the end that enters the corresponding chamber 801*d*, so that a user can push the pin 801*a* back into its chamber 801*b* against the bias of the biasing means 801*c* using the corresponding chamber 801*d*, for instance by pushing the at least one handle rod back into a retracted position. There may be several corresponding chambers 801*d*, or alternatively, several pins 801*a* at various positions along the at least one handle rod or along a surface past which the at least one handle rod slides, so that the at least one handle rod can be secured at various degrees of extension or retraction. Where the at least one handle rod includes first handle rod 501 and a second handle rod 504, the same engagement latch 801 may secure both the first handle rod 501 and the second handle rod 504 relative to the luggage item 508, or multiple engagement latches 801 may be used to secure the first handle rod 501 and the second handle rod 504. Likewise, one or more engagement latches may engage one component of the at least one handle rod with another component of the at least one handle rod; for example, where the at least one handle rod is made up of telescoping sections, the one or more engagement latches may fix two sections together so they are not mutually slidable until the one or more engagement latches have been disengaged.

In some embodiments, as illustrated in FIGS. 8C-8E, the one or more engagement latches 801 are disengaged by the action of at least one actuator 803. The at least one actuator 803 may be in the handle portion 500*a* of the extension handle 500. The at least one actuator 803 may move in a direction 803*a* that is substantially orthogonal to the direction of motion 801*a* of the one ore more engagement latches 801. The at least one actuator 803 may be physically coupled to the one or more engagement latches 801 so that when the at least one actuator moves, it causes the one or more engagement latches 801 to retract, disengaging the one or more engagement latches 801. Persons skilled in the art will be aware of many ways to physically couple two members whereby a substantially linear motion in a first direction 803*a* by at least one actuator 803 may be converted to a substantially linear motion in a substantially orthogonal second direction 801*e* by a second member 801. As a non-limiting example, illustrated in FIG. 8E, a face 804 of an actuator 803 that forms an acute angle with the direction of motion 803*a* of the actuator 803 may be forced past a surface 805 of an engagement latch 801 that is substantially orthogonal to the direction of motion 801*e* of the engagement latch 801, forcing the engagement latch 801 to move in the direction of motion 801*a*. A biasing means 801*c*, such as a spring, may urge the engagement latch 801 in the opposite direction and into its engaged position when the actuator 803 is not being forced in the direction of motion 803*a*.

The at least one actuator 803 may be constructed of any material or combination of materials suitable for the construction of the at least one handle rod 501; for instance, the at least one actuator 803 may be constructed of metal. The at least one actuator 803 may be constructed in any shape conducive for its use in transferring linear motion to a latch 801. For instance, part of the at least one actuator 803 may be a rod that runs in the direction of motion 803*a* of the actuator from near the grip 507 to the at least one latch 801. An actuator 803 may include a rod 803*b* slidably contained inside of the first handle rod, so that the rod 803*b* can slide down within the first handle rod 501 when the actuator 803 moves in its direction of motion 803*a*; as the at least one latch 801 may be set partially inside of the first handle rod 501, the physical coupling between the rod 803*b* set within the first handle rod 501 and the at least one latch 801 may also be inside of the first rod 501. Similarly, where the handle portion 500*a* includes a first handle rod 501 and a second handle rod 504, the at least one actuator 803 may include a rod 803*b* set inside the first handle rod 501 as described above, and the at least one actuator 803 may include a rod 803*c* that is set inside of the second handle rod 504; the rod 803*c* may couple with a latch 801 that is partially set inside of the second handle rod 504. In some embodiments, the at least one actuator 803 includes a cross-bar 803*d* joining the first rod 803*b* to the second rod 803*c*; the cross-bar 803*d* may be located at the end of the handle portion 500*a* near to the grip 507.

In some embodiments, the at least one actuator 803 is pushed in its direction of motion 803*a* when a button 806 physically coupled to the at least one actuator 803 is depressed by a user. The button 806 may have one or more biasing means 807 urging it into a non-depressed state when it is not being depressed by a user; as a non-limiting example, the one or more biasing means 807 may be one or more springs.

The button 806 may be coupled to the at least one actuator 803 by a motion transfer ring 808 that contacts the at least one actuator 803. The motion transfer ring 808 may contact the at least one actuator 803 by way of a motion transfer rod 809 that passes through an opening that connects the interior space inside the grip 507 to an interior space inside the handle portion 500*a*. The motion transfer rod may contact the at least one actuator 803. In some embodiments, the motion transfer rod is connected to the at least one actuator 803 by a swivel. In other embodiments, the end of the motion transfer rod 809 rests against the at least one actuator 803. As a non-limiting example, the at least one actuator 803 may have a depression in which the end of the motion transfer rod 809 rests, so that the motion transfer rod 809 may be rotated with respect to the at least one actuator 803 but does not easily slip off of the at least one actuator 803. The motion transfer rod may be connected to the motion transfer ring 808 by a swivel. The motion transfer rod may rest against the motion transfer ring 808. In some embodiments, the motion transfer rod can swivel with respect to the motion transfer ring 808 and is fixed to the at least one actuator 803. In other embodiments, the motion transfer rod 809 can swivel with respect to the at least one actuator 803 and is fixed to the motion transfer ring 808. Where the grip 507 is joined to the distal end of the at least one handle rod by a swivel 600, the opening may pass through the swivel 600; as a result, the grip 507 may be able to swivel together with the motion transfer ring 808 with respect to the handle portion 500*a* and the at least one actuator 803. Where the grip 507 is joined to the distal end of the at least one handle rod by a neck portion 605, the opening may pass through the neck portion 605. As a result, the grip 507 and motion transfer ring 808 may be able to rotate as far as permitted by the range of motion of the neck portion 605.

The motion transfer ring 808 may be set inside the grip 507; in other words, the motion transfer ring 808 may be inside the interior space 507*g* of the grip 507. The motion transfer ring 808 may have a shape that complements the shape of the grip 507. For instance, where the grip 507 is ring-shaped, the motion transfer ring 808 may form a ring corresponding to the shape of the grip 507, and set inside an interior hollow portion of the grip 507. As a non-limiting example, where the grip 507 forms a toroidal ring, the motion transfer ring 808 may have a substantially circular form, and be inside of the grip 507. Likewise, where the grip 507 is a D-ring, the motion transfer ring 808 may be a D-ring inside of the grip 507, and where the grip 507 is a square ring, the motion transfer ring 808 may be a square ring inside of the grip 507. As a result, the motion transfer ring 808 may be free to move in the direction of motion 803*a* of the at least one actuator 803 when the button 806 is depressed, while remaining inside of the grip 507, causing the actuator 803 to move in its direction of motion 803*a*. As a result, the user may not see the motion transfer ring, actuator, or latches at all, and the resulting user experience may be that the handle 500 locks in place in one or more extended positions, and becomes retractable when the button 806 is depressed. The motion transfer ring 808 may be constructed of any material or combination of materials suitable for the construction of the at least one actuator 803; for instance, the motion transfer ring may be constructed of metal. In some embodiments, the extension handle 500 includes a rotation lock (not shown) that prevents the grip 507 from rotating relative to the handle portion 500*a* when the rotation lock is engaged, and permits the grip 507 to rotate relative to the handle portion when the rotation lock is disengaged.

As illustrated in FIGS. 9A-9D, the extension handle 500 may include a chamber 901 from which the extension handle 500 extends and into which the extension handle 500 retracts. The chamber 901 may be incorporated in the luggage 508 (i.e., within the luggage 508), or it may be part of or formed by an external component attached to the exterior of the luggage 508 using fasteners such as screws, rivets, hook and loop fasteners, straps with buckles, or any other appropriate fastener, as would be appreciated by a person having ordinary skill in the art. The chamber 901 may have a first end 902. The first end 902 may be at any of the side, front, or rear edges of the luggage. The chamber 901 may have a second end 903. The second end 903 may be opposite the first end 902; for instance, if the first end 902 is located at one side of the luggage 508, the second end 903 may be located at the opposite side of the luggage 508. The chamber 901 may include a first side 904; the first side 904 may be parallel to an edge of the luggage 508. The chamber 901 may have a second side 905 parallel to and opposite to the first side 904. The chamber 901 may have an opening 906 at the first end 902. The chamber 901 may be closed at the first side 904, second side 905, and second end 903. In some, embodiments, where the at least one handle rod includes a first handle rod 501 and a second handle rod 504, the first handle rod 501 and second handle rod 504 are inserted within the chamber 901 along the first side 904 and the second side 905 of the chamber 901. The at least one handle rod may be free to slide out of the opening 906 into an extended position, as shown in FIG. 5A. When in the extended position, the distal end 503 of the first handle rod 501 may extend out of the chamber 901 and the proximal end 502 of the first handle rod 501 may remain within the chamber 901.

The extension handle 500 may include at least one interior rod; the at least one handle rod may have a slot that slidably admits the at least one interior rod. In some embodiments, where the at least on handle rod includes a first handle rod 501 and a second handle rod 504, the at least one interior rod includes two interior rods 912 inserted in the chamber 901 along the front 904 and back 905 sizes of the chamber 901. In some embodiments, each handle rod 501, 504 has a slot 913 that slidably admits one of the two interior rods 912. As a non-limiting example, there may be a first interior rod inserted in the chamber 901 along the first side 904 of the chamber 901, the first handle rod 501 may contain a slot that slidably admits the first interior rod, and a first engagement latch may fix the first handle rod 501 to the first interior rod, and there may be a second interior rod inserted in the chamber along the second side 905 of the chamber, the second handle rod 504 may contain a slot that slidably admits the second interior rod, and a second engagement latch may fix the second handle rod 504 to the second interior rod. The at least one handle rod may be restricted by the interior rods 912 so that the at least one handle rod can only travel linearly by sliding along the rods 912. In some embodiments, the at least one engagement latch 801 fixes the at least one handle rods to the interior rods 912. Where there is at least one pocket 700, the at least one pocket 700 may be capable of sliding into and out of the chamber 901 with the at least one handle rod; for instance, when the extension handle 500 includes both the first handle rod 501 and the second handle rod 504, the at least one pocket 700 may be confined to the space between the first handle rod 501 and the second handle rod 504 when the pocket 700 is closed.

As a non-limiting example, the extension handle 500 may retract into a chamber 901 in the bottom panel 101 of the collapsible suitcase 100. The first end 902 of the chamber 901 may be located at one side edge of the bottom panel 101; the second end 903 may be located at the other side edge of the bottom panel 101. Likewise, the first side 904 may be parallel to, and near to, an edge of the bottom panel 101, such as the front edge of the bottom panel 101. The second side 905 of the chamber 901 may be parallel to and proximal to the rear edge of the bottom panel 101.

Figure 10A:
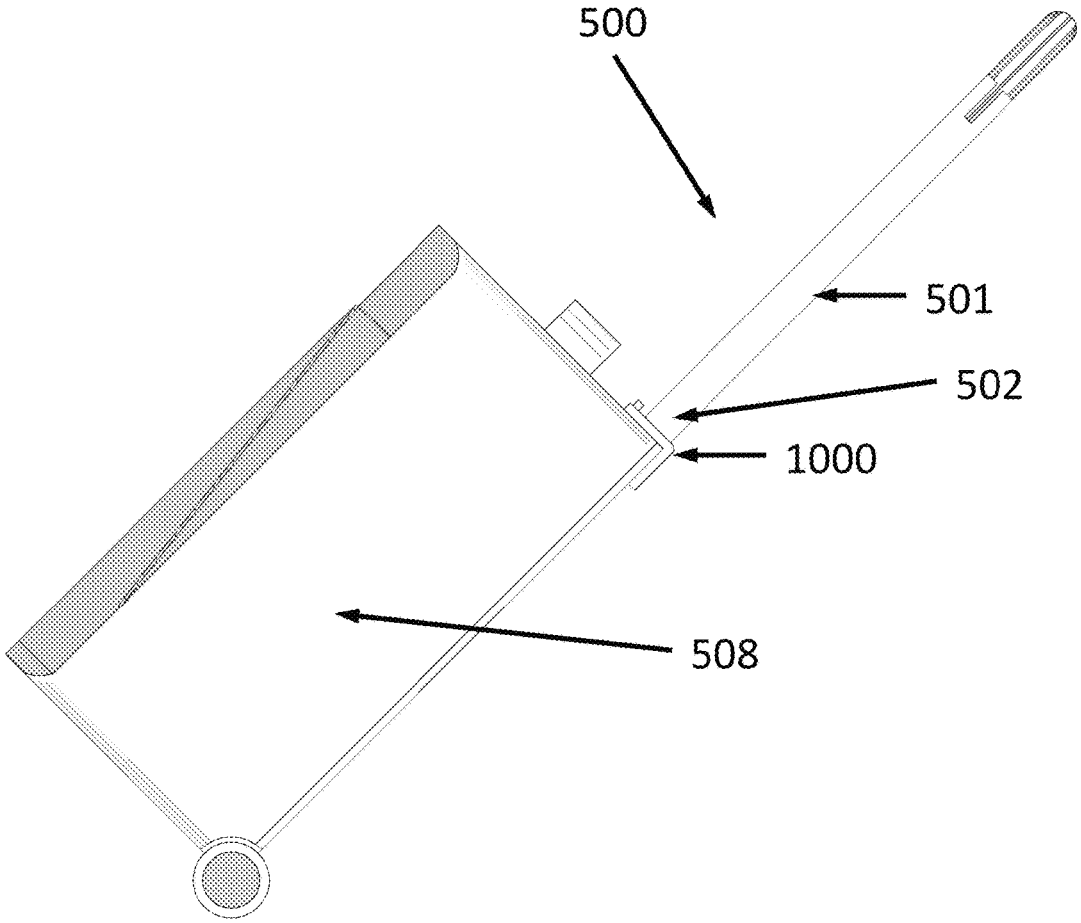
FIG. 10A is a schematic diagram illustrating one embodiment of an extension handle attached to an item of luggage.
Figure 10B:
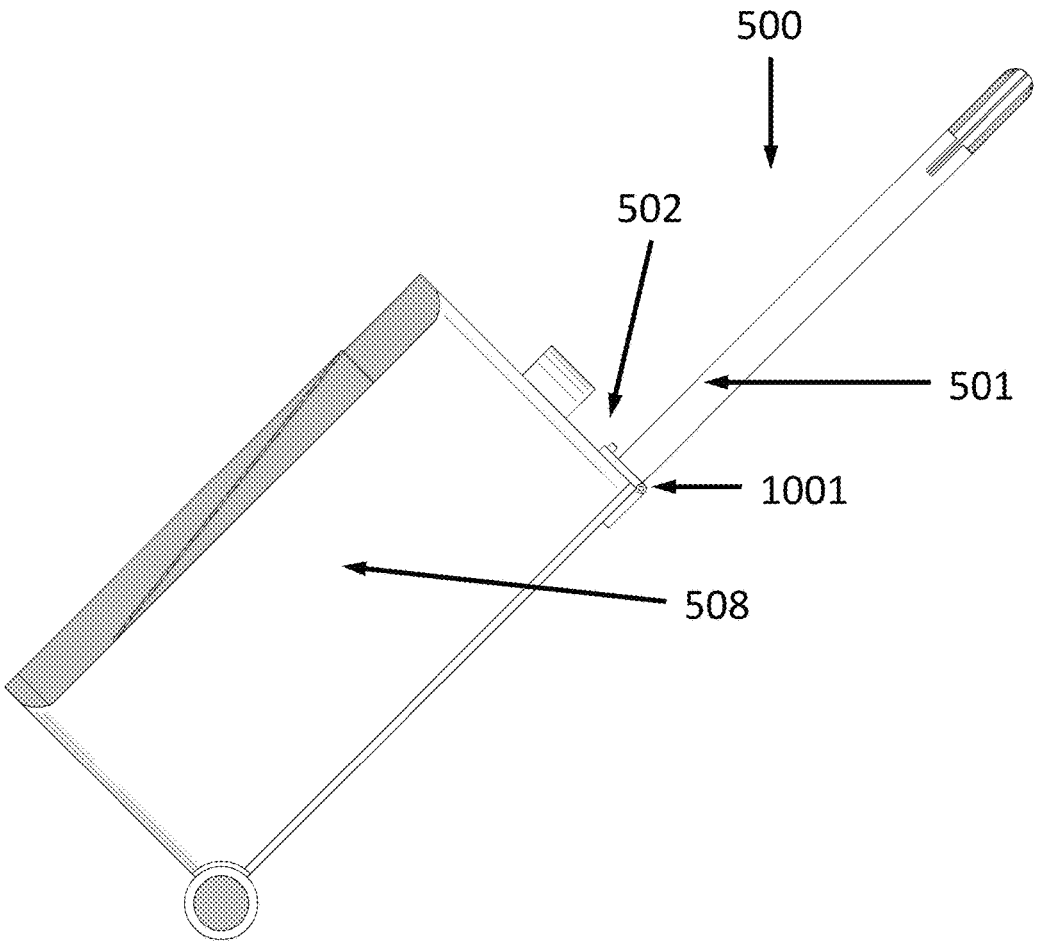
FIG. 10B is a schematic diagram illustrating one embodiment of an extension handle attached to an item of luggage.
Figure 10C:
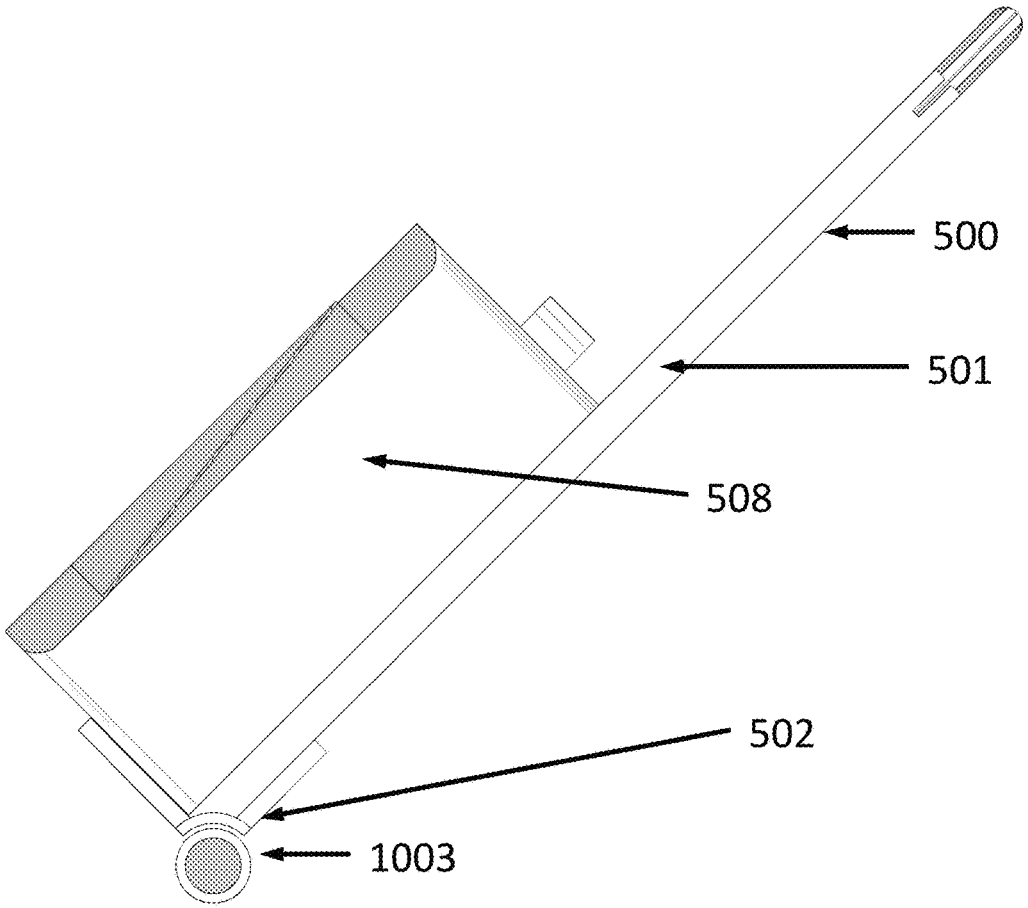
FIG. 10C is a schematic diagram illustrating one embodiment of an extension handle attached to an item of luggage.

The extension handle 500 may be attached to the item of luggage 508 in a non-retractable fashion. For instance, as shown in FIG. 10A, the handle 500 may be fixed to the luggage 508; for instance, the proximal end 502 of the first handle rod 501 may be bolted, screwed, riveted, or otherwise fastened to the luggage 508. A brace 1000 may attach the first handle rod 501 to the luggage, for added stability. The fixed attachment may be detachable; for instance, the extension handle 500 may be removably clamped or screwed to the luggage 508. In other embodiments, as shown in FIG. 10B, the proximal end 502 of the first handle rod 501 is attached to the item of luggage 508 by a connector 1001. The connector 1001 may be any attachment that allows the first handle rod 501 to rotate relative to the luggage 508; the connector 1001 may allow the handle 500 to be stowed in a position in which it is substantially flat against the luggage 508. The connector 1001 may be any kind of connector, including, but not limited to, a hinge (e.g., a pin hinge, a living hinge), a ball joint, or a strip of flexible material attached to both the extension handle 500 and the luggage 508. A fastener 1002 may allow a user to engage the extension handle 500 with the luggage 508 so that the extension handle 500 remains in deployed position while in use. In another embodiment, as shown in FIG. 10C, the proximal end 502 of the first handle rod 501 is coupled to a wheel 1003, and the item of luggage, which has a compartment for holding items, is attached to the extension handle 500 between the distal end 503 of the first handle rod 501 and the proximal end 502 of the first handle rod 501. For instance, the extension handle 500 may be a "dolly" or similar cart-like apparatus to which luggage 508 or other receptacles or platforms for transporting items may be attached. The luggage 508 may be attached to the extension handle 500 using straps (not shown), fasteners (not shown), or any other means for attaching one object to another object.

Figure 11:
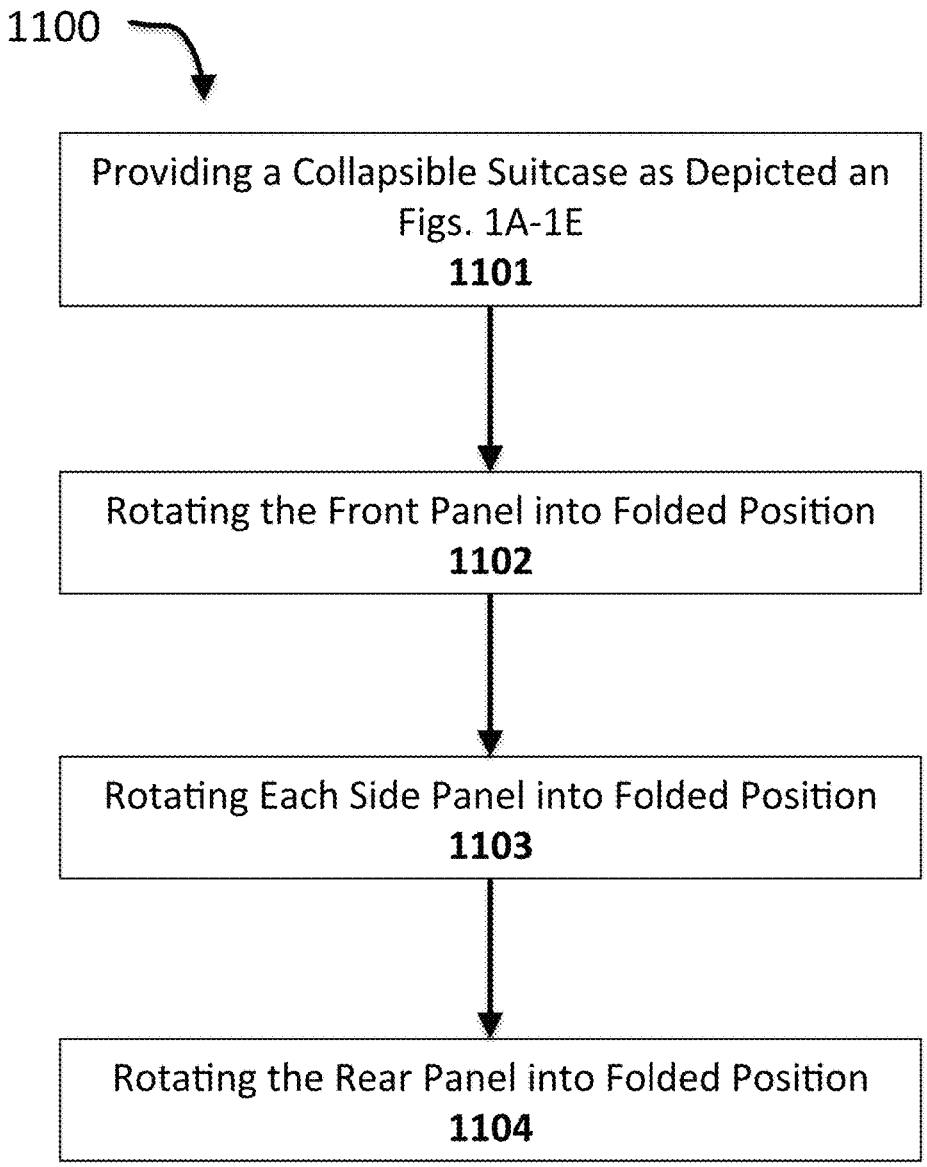
FIG. 11 is a flow diagram illustrating one embodiment of the disclosed method for collapsing a collapsible suitcase.

FIG. 11 is a flow chart illustrating one embodiment of the disclosed method 1100 for collapsing a collapsible suitcase. The method 1100 includes providing a collapsible suitcase as describe above in reference to FIGS. 1A-1E (1101). The method 1100 includes rotating the front panel into folded position (1102). In some embodiments, this is implemented as described above in reference to FIG. 2A. Rotating the front panel 106 may include disengaging the latch 128 as shown in FIG. 2A. The method 1100 includes rotating each side panel into folded position (1103); in some embodiments this is implemented as illustrated in FIG. 2B. The method 1100 may further include folding a portion of the exterior covering 400 up over the side panels, as depicted in FIG. 2B. The method 1100 includes rotating the rear panel into folded position (1104); in some embodiments, this is implemented as depicted in FIG. 2C. Some embodiments further include wrapping the lid 406 around the suitcase 100 after the suitcase 100 has been collapsed; in some embodiments, the lid 406 is secured to the second portion 400*b* of the exterior covering 400 using the fastener 202.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

What is claimed is:

1. A handle, comprising:

a first handle rod having a distal end and a proximal end;

a second handle rod having a distal end and a proximal end, the second handle rod coupled to the first handle rod and disposed parallel to the first handle rod;

a grip coupled to the distal end of the first handle rod and to the distal end of the second handle rod by a neck portion having a first end fixedly attached to the grip and a second end attached to the distal end of the first handle rod and the distal end of the second handle rod or a to a rod joining the distal end of the first handle rod to the distal end of the second handle rod, wherein the neck portion is configured to deform elastically about a rotational axis between the first and second ends of the next portion when the grip is rotated about the rotational axis; and a pocket disposed between the first handle rod and the second handle rod.

2. The handle of claim 1, wherein the rotational axis is substantially parallel to the first and second handle rods.

3. The handle of claim 1, wherein the neck portion has a range of motion in two directions of rotation about the rotational axis, permitting the grip to rotate at most ninety degrees in either direction of rotation.

4. The handle of claim 1, wherein the grip comprises a slide track permitting the grip to be rotated about a second axis.

5. The handle of claim 4, wherein the second axis is substantially perpendicular to the first and second handle rods.

6. The handle of claim 1, wherein the grip is substantially toroidal.

7. The handle of claim 1, further comprising:

a fold-out tray disposed in the pocket, the fold-out tray comprising a main panel, the main panel having a distal end, a proximal end, and a work surface; and a first connector slidably coupled to the proximal end of the main panel and to the first and second handle rods, the first connector permitting the fold-out tray to be rotated between a first position in which the work surface is substantially parallel to the first and second handle rods and a second position in which the work surface is substantially perpendicular to the first and second handle rods.

8. The handle of claim 7, wherein the fold-out tray further comprises a leaf coupled to the main panel by a second connector configured to permit the leaf to rotate between a folded position in which a first surface of the leaf is resting on the work surface and a deployed position in which the first surface of the leaf is substantially adjacent and parallel to the work surface of the main panel.

9. The handle of claim 8, wherein the second connector is a hinge.

10. The handle of claim 7, wherein the distal end of the main panel includes a lip.

11. An item of luggage comprising the handle of claim 1.

12. The item of luggage of claim 11, wherein the item of luggage comprises a chamber having an opening, and wherein the first and second handle rods are inserted within the chamber so that the first and second handle rods are capable of being slid out of the opening into an extended position with the distal end of the first handle rod extending out of the chamber and the proximal end of the first handle rod remaining within the chamber and with the distal end of the second handle rod extending out of the chamber and the proximal end of the second handle rod remaining within the chamber.

13. The item of luggage of claim 12, further comprising:

one or more engagement latches configured to keep the proximal end of the first handle rod within the chamber and to keep the proximal end of the second handle rod within the chamber when the first and second handle rods are in the extended position.

14. The item of luggage of claim 13, wherein the first handle rod includes a first slot and the second handle rod includes a second slot, and further comprising:

a first interior rod in the chamber, wherein the first slot of the first handle rod slidably admits the first interior rod; and a second interior rod in the chamber, wherein the second slot of the second handle rod slidably admits the second interior rod, and wherein the one or more engagement latches couple the first handle rod to the first interior rod and the second handle rod to the second interior rod.

15. The item of luggage of claim 11, wherein the proximal end of the first handle rod and the proximal end of the second handle rod are affixed to the item of luggage.

16. The item of luggage of claim 11, wherein the proximal end of the first handle rod and the proximal end of the second handle rod are coupled to the item of luggage by a connector.

17. The item of luggage of claim 16, wherein the connector is a hinge.

18. The handle of claim 1, wherein the proximal end of the first handle rod is attached to a first wheel and the proximal end of the second handle rod is attached to a second wheel, and further comprising a receptacle attached to the handle between the distal end of the first handle rod and the proximal end of the first handle rod and between the distal end of the second handle rod and the proximal end of the second handle rod.

19. The handle of claim 1, wherein the pocket comprises one or more flaps.

20. The handle of claim 19, wherein the one or more flaps comprise a fastener.

21. The handle of claim 20, wherein the fastener comprises a hook-and-loop fastener, a zipper, a button, or a snap configured to secure a contents of the pocket when the one or more flaps are closed.

* * * * *